US009377231B2

(12) United States Patent
Oh et al.

(10) Patent No.: US 9,377,231 B2
(45) Date of Patent: Jun. 28, 2016

(54) REFRIGERATING CYCLE APPARATUS AND METHOD FOR OPERATING THE SAME

(71) Applicant: LG ELECTRONICS INC., Seoul (KR)

(72) Inventors: Minkyu Oh, Seoul (KR); Jangseok Lee, Seoul (KR); Myungjin Chung, Seoul (KR); Chanho Jeon, Seoul (KR); Sunam Chae, Seoul (KR); Juyeong Heo, Seoul (KR); Kwangwook Kim, Seoul (KR); Hoyoun Lee, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 9 days.

(21) Appl. No.: 14/503,756

(22) Filed: Oct. 1, 2014

(65) Prior Publication Data

US 2015/0068229 A1 Mar. 12, 2015

Related U.S. Application Data

(63) Continuation of application No. 13/491,651, filed on Jun. 8, 2012, now Pat. No. 8,863,533.

(30) Foreign Application Priority Data

Jun. 8, 2011 (KR) ..... 10-2011-0055044
May 10, 2012 (KR) ..... 10-2012-0049898

(51) Int. Cl.
*F25B 49/02* (2006.01)
*F25B 1/10* (2006.01)
(Continued)

(52) U.S. Cl.
CPC ..... *F25B 49/022* (2013.01); *F25B 1/10* (2013.01); *F25B 31/004* (2013.01); *F25B 43/02* (2013.01); *F25B 2400/073* (2013.01); *F25B 2600/02* (2013.01); *F25B 2700/03* (2013.01)

(58) Field of Classification Search
CPC ..... F25B 1/10; F25B 31/004; F25B 49/022; F25B 43/02; F25B 2600/02; F25B 2700/03; F25B 2400/073
USPC ..... 62/84, 193
See application file for complete search history.

(56) References Cited

U.S. PATENT DOCUMENTS 2,178,100 A 10/1939 Gygax ..... 230/7
4,394,816 A * 7/1983 Voorhis ..... F25B 1/10 137/625.3

(Continued)

FOREIGN PATENT DOCUMENTS

CN 1605818 A 4/2005
CN 1898505 A 1/2007

(Continued)

OTHER PUBLICATIONS

Office Action dated Jan. 22, 2014, issued in U.S. Appl. No. 13/491,651.

(Continued)

*Primary Examiner* — Mohammad M Ali
(74) *Attorney, Agent, or Firm* — Ked & Associates, LLP

(57) ABSTRACT

A refrigerating cycle apparatus and a method of operating the same are provided. For a refrigerating cycle having a plurality of compressors connected in series for multi-stage compression, an inner space of each compressor and a pipe of the refrigerating cycle may be connected via an oil collection pipe, and oil may be discharged into the refrigerating cycle by pressure reversal during a pressure balancing operation, so as to allow the discharged oil to be collected into a high-stage compressor or a low-stage compressor. Accordingly, an amount of oil may be uniformly maintained in each of the plurality of compressors to prevent losses due to friction and/or increases in power consumption due to a lack of oil in one or more of the compressors. The structure of a device and pipes for performing oil balancing between the compressors may be simplified to enhance efficiency of the compressors.

21 Claims, 21 Drawing Sheets

(51) Int. Cl.
*F25B 31/00* (2006.01)
*F25B 43/02* (2006.01)

(56) References Cited

U.S. PATENT DOCUMENTS

| | | | | |
|---|---|---|---|---|
| 4,454,725 | A * | 6/1984 | Cann | F24D 15/04 62/117 |
| 5,220,806 | A | 6/1993 | Jaster et al. | 62/179 |
| 5,235,820 | A | 8/1993 | Radermacher et al. | 62/114 |
| 5,522,233 | A * | 6/1996 | Nares | F04B 39/04 417/228 |
| 6,161,391 | A * | 12/2000 | Trieskey | F25B 5/02 62/335 |
| 6,405,554 | B1 * | 6/2002 | Kawakatu | F25B 7/00 62/175 |
| 6,460,355 | B1 * | 10/2002 | Trieskey | F25B 5/02 62/175 |
| 6,536,518 | B2 * | 3/2003 | Trieskey | F25B 5/02 165/240 |
| 6,557,358 | B2 * | 5/2003 | Weng | C09K 5/045 252/67 |
| 6,766,652 | B2 * | 7/2004 | Kelly | F25B 7/00 62/199 |
| 7,137,265 | B2 | 11/2006 | Kim | 62/192 |
| 7,918,106 | B2 | 4/2011 | Fujimoto et al. | 62/470 |
| 2002/0148239 | A1 * | 10/2002 | Trieskey | F25B 5/02 62/79 |
| 2003/0010042 | A1 * | 1/2003 | Weng | C09K 5/045 62/114 |
| 2005/0144973 | A1 * | 7/2005 | Matsumoto | F04C 18/3564 62/470 |
| 2005/0183447 | A1 * | 8/2005 | Matsumoto | F04C 18/3564 62/470 |
| 2006/0032267 | A1 * | 2/2006 | Kamimura | F25B 1/10 62/498 |
| 2006/0254307 | A1 * | 11/2006 | Shapiro | F04B 25/00 62/498 |
| 2007/0144190 | A1 | 6/2007 | Temmyo et al. | 62/180 |
| 2007/0227184 | A1 | 10/2007 | Son et al. | 62/528 |
| 2007/0245768 | A1 * | 10/2007 | Sakae | F25B 1/10 62/470 |
| 2008/0085195 | A1 | 4/2008 | Shaw | 417/244 |
| 2008/0209924 | A1 | 9/2008 | Yoon et al. | 62/84 |
| 2009/0031737 | A1 * | 2/2009 | Ueno | F25B 13/00 62/151 |
| 2009/0229300 | A1 | 9/2009 | Fujimoto et al. | 62/470 |
| 2010/0146999 | A1 * | 6/2010 | Okamoto | F25B 9/06 62/238.6 |

FOREIGN PATENT DOCUMENTS

| | | | |
|---|---|---|---|
| CN | 101180505 | A | 5/2008 |
| EP | 2034258 | A1 | 3/2009 |

OTHER PUBLICATIONS

Chinese Office Action dated Feb. 27, 2014, issued in Application No. 201210189047.8.

Notice of Allowance dated Jun. 19, 2014, issued in U.S. Appl. No. 13/491,651.

* cited by examiner

| DRIVING CONDITION / RESULT | PRIMARY Comp (TDC) | SECONDARY Comp (OFF) |
|---|---|---|
| INITIAL OIL LEVEL [mm] | 43.8 | 58 |
| FINAL OIL LEVEL [mm] | 45.5 | 60 |
| CHANGE IN AN AMOUNT OF OIL(cc) [30min] | 5.9 | 8 |

| DRIVING CONDITION / RESULT | PRIMARY Comp (OFF) | SECONDARY Comp (TDC) |
|---|---|---|
| INITIAL OIL LEVEL [mm] | 61 | 47.5 |
| FINAL OIL LEVEL [mm] | 62.5 | 42.5 |
| CHANGE IN AN AMOUNT OF OIL(cc) [60min] | 6 | -18 |

| DRIVING CONDITION / RESULT | PRIMARY Comp (4.5mm) | SECONDARY Comp (TDC) |
|---|---|---|
| INITIAL OIL LEVEL [mm] | 62 | 45 |
| FINAL OIL LEVEL [mm] | 62.8 | 44 |
| CHANGE IN AN AMOUNT OF OIL(cc) [60min] | 3 | -4 |

| DRIVING CONDITION / RESULT | PRIMARY Comp (OFF) | SECONDARY Comp (TDC) |
|---|---|---|
| INITIAL OIL LEVEL [mm] | 49.8 | 54.5 |
| FINAL OIL LEVEL [mm] | 50 | 54 |
| CHANGE IN AN AMOUNT OF OIL(cc) [15min] | 1 | -3 |

| DRIVING CONDITION / RESULT | PRIMARY Comp (4.5mm) | SECONDARY Comp (TDC) |
|---|---|---|
| INITIAL OIL LEVEL [mm] | 53.5 | 49.8 |
| FINAL OIL LEVEL [mm] | 53.8 | 49.5 |
| CHANGE IN AN AMOUNT OF OIL(cc) [15min] | 0.5 | -1 |

REFRIGERATING CYCLE APPARATUS AND METHOD FOR OPERATING THE SAME

CROSS-REFERENCE TO RELATED APPLICATION(S)

This application is a Continuation Application of prior U.S. patent application Ser. No. 13/491,651 filed Jun. 8, 2012, which claims priority under 35 U.S.C. §119 to Korean Application No. 10-2011-0055044 filed on Jun. 8, 2011 and Korean Application No. 10-2012-0049898 filed on May 10, 2012, whose entire disclosures are hereby incorporated by reference.

BACKGROUND

1. Field

This specification relates to a refrigerating cycle apparatus and a method for operating the same, and particularly.

2. Background

In general, a refrigerating cycle apparatus may employ a compressor, a condenser, an expansion apparatus and an evaporator to keep an inside of a refrigeration device such as a refrigerator at a low temperature. The refrigerating cycle apparatus may use oil to protect the compressor from mechanical friction. The oil may circulate in the refrigerating cycle mixed with high temperature and high pressure refrigerant gas discharged from the compressor.

When the oil is accumulated in the condenser or evaporator of the refrigerating cycle or pipes connecting various elements of the cycle, a capability of the refrigerating cycle may be degraded and result in a lack of oil in the compressor, thus damaging the compressor.

In a refrigerating cycle having a single compressor, an amount of collected oil may be known based on a speed at which refrigerant is collected and flows back into an inlet. Hence, an operation of the compressor may be controlled based on the amount of oil collected so as to prevent degradation of the capability of the refrigerating cycle damage to or the compressor due to the lack of oil.

In a refrigerating cycle having a plurality of compressors, refrigerant and oil may be concentrated in one compressor based on a particular driving mode. This may cause a lack of oil in the other compressors, thereby degrading the capability of the refrigerating cycle and/or causing damage to the compressor(s).

In such a refrigerating cycle apparatus having a plurality of compressors connected to each other, during the refrigerating cycle, oil filled in each compressor may be discharged from the compressors into the refrigerating cycle together with refrigerant. This may cause an oil unbalance between the compressors. Especially, when the plurality of compressors are connected in series so as to perform a multi-stage compression of a refrigerant, a different amount of oil flows in each compressor. Accordingly, oil may be concentrated in one compressor, and the other compressors may consequently suffer from an insufficient amount of oil. This may result in a frictional loss and an increase in power consumption.

Furthermore, in a refrigerating cycle apparatus having a plurality of compressors, when an oil balancing container is separately installed at outside of the compressors in order to address the oil unbalance between the compressors, an amount of space occupied by the compressor(s) is increased due to the installation of the oil balancing container and pipes, which may have a complicated structure, increasing flow resistance and lowering cooling efficiency.

BRIEF DESCRIPTION OF THE DRAWINGS

The embodiments will be described in detail with reference to the following drawings in which like reference numerals refer to like elements wherein.

DETAILED DESCRIPTION

Description will now be provided of a refrigerating cycle apparatus and a method for operating the same according to the exemplary embodiments, with reference to the accompanying drawings. For the sake of brevity, the same or similar components will be referred to by the same reference numbers wherever possible, and detailed description thereof will not be repeated.

Figure 1:
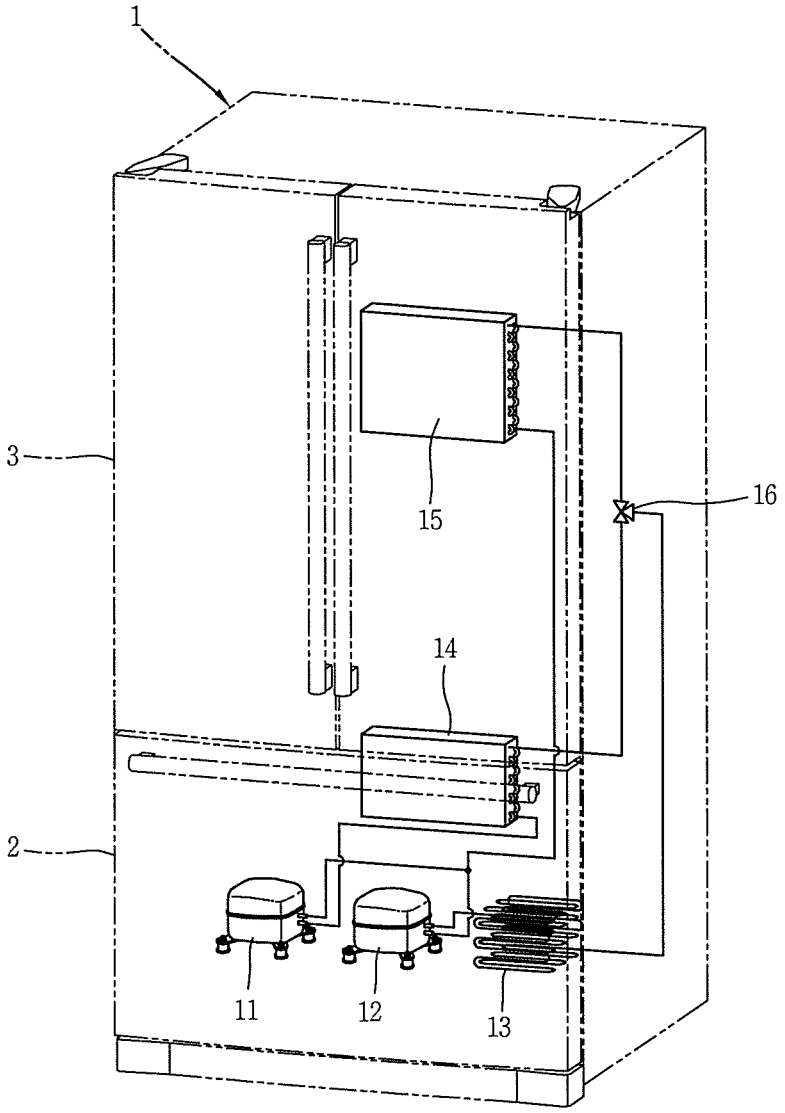
FIG. 1 is a perspective view of an exemplary refrigerator for describing a refrigerating cycle apparatus as embodied and broadly described herein.
Figure 2:
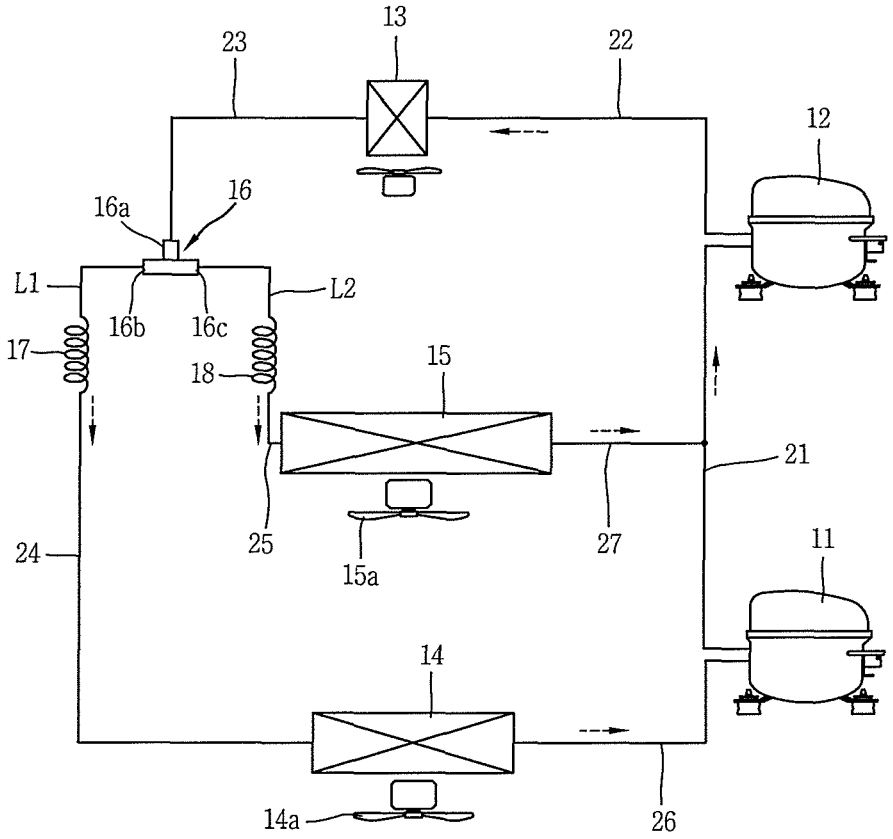
FIG. 2 is a schematic view of a refrigerating cycle apparatus of the refrigerator shown in FIG. 1, in accordance with embodiments as broadly described herein.

As shown in FIGS. 1 and 2, a refrigerator may include a refrigerator main body 1 having a freezing chamber and a refrigerating chamber, and a freezing chamber door 2 and a refrigerating chamber door 3 for opening and closing the freezing chamber and the refrigerating chamber of the refrigerator main body 1, respectively.

A machine chamber may be located at a lower side of the refrigerator main body 1. A plurality of compressors 11 and 12 and one condenser 13 of a refrigerating cycle for generating cold air may be installed in the machine chamber. The plurality of compressors 11 and 12 may be configured so that an outlet of a primary compressor 11 is connected to an inlet of a secondary compressor 12 via a first refrigerant pipe 21, which may allow a refrigerant, which has undergone primary compression in the primary compressor 11 at relatively low pressure, to undergo secondary compression in the secondary compressor. An outlet of the secondary compressor 12 may be connected to an inlet of the condenser 13 via a second refrigerant pipe 22. In certain embodiments, the primary compressor 11 and the secondary compressor 12 may be designed to have the same capacity. However, in alternative embodiments, such as, for example, in a refrigerator where refrigerating chamber driving may be more frequently performed, the secondary compressor 12, which performs the refrigerating chamber driving, may have a greater capacity than that of the primary compressor 11, for example, by approximately two times, or other factor as appropriate given relative capacities and cooling requirements of the chambers.

A refrigerant switching valve 16 may be connected to an outlet of the condenser 13 via a third refrigerant pipe 23. The refrigerant switching valve 16 may control a refrigerant flow direction toward a first evaporator 14 or a second evaporator 15.

The refrigerant switching valve 16 may be, for example, a three-way valve, including, for example, an inlet 16*a* connected to the outlet of the condenser 13, and a first outlet 16*b* and a second outlet 16*c* which communicate with the inlet 16*a* selectively or simultaneously. A first diverging pipe L1 may be connected to the first outlet 16*b*, and a second diverging pipe L2 may be connected to the second outlet 16*c*.

A first expansion apparatus 17 may be connected to the first diverging pipe L1. A fourth refrigerant pipe 24 may be connected to an outlet of the first expansion apparatus 17. A first evaporator 14 for cooling the freezing chamber may be connected to the fourth refrigerant pipe 24.

A second expansion apparatus 18 may be connected to the second diverging pipe L2, and a fifth refrigerant pipe 25 may be connected to an outlet of the second expansion apparatus 18. A second evaporator 15 for cooling the refrigerating chamber may be connected to the fifth refrigerant pipe 25.

In certain embodiments, the first evaporator 14 and the second evaporator 15 may be designed to have the same capacity. In certain embodiments, similar to the compressors discussed above, the second evaporator 15 may have a greater capacity than that of the first evaporator 14. Blowing fans 14*a* and 15*a* may be installed at one side of the first evaporator 14 and one side of the second evaporator 15, respectively.

An outlet of the first evaporator 14 may be connected to a suction side of the primary compressor 11 via a sixth refrigerant pipe 26, and an outlet of the second evaporator 15 may be connected to a suction side of the secondary compressor 12 via a seventh refrigerant pipe 27. Alternatively, instead of being directly connected to the suction side of the secondary compressor, the seventh refrigerant pipe 27 may join the first refrigerant pipe 21, which is connected to the outlet of the primary compressor 11, at a middle portion of the first refrigerant pipe 21, so as to be connected to the suction side of the secondary compressor 12. Consequently, the primary compressor 14 and the secondary compressor 12 may be connected in parallel to each other.

In a refrigerator having a refrigerating cycle so configured, the refrigerant switching valve 16 controls a refrigerant to flow toward the first evaporator 14 or the second evaporator 15 according to a driving mode of the refrigerator. This may implement a simultaneous driving mode for driving both the refrigerating chamber and the freezing chamber, or a freezing chamber driving mode for driving only the freezing chamber, or a refrigerating chamber driving mode for driving the refrigerating chamber.

For example, in the simultaneous driving mode for driving both the freezing chamber and the refrigerant chamber, both the first outlet 16*b* and the second outlet 16*c* of the refrigerant switching valve 16 are open so that refrigerant passing through the condenser 13 can flow toward both the first evaporator 14 and the second evaporator 15.

Accordingly, the refrigerant, which is introduced into the primary compressor 11 via the first evaporator 14, undergoes primary compression in the primary compressor 11 and is then discharged. The primarily-compressed refrigerant discharged from the primary compressor 11 is then introduced into the secondary compressor 12. Here, the refrigerant passing through the second evaporator 15 flows into the first refrigerant pipe 21 via the seventh refrigerant pipe 27, and is mixed with the refrigerant discharged after undergoing primary compression in the primary compressor 11, thereby being introduced into the secondary compressor 12.

The primarily-compressed refrigerant and the refrigerant having passed through the second evaporator 12 are compressed in the secondary compressor 12 and then discharged. The refrigerant discharged out of the secondary compressor 12 flows into the condenser 13 and is then condensed. The refrigerant condensed in the condenser 13 is distributed to the first evaporator 14 and the second evaporator 15 by the refrigerant switching valve 16. These processes are repeatedly performed.

In the freezing chamber driving mode, the refrigerant switching valve 16 closes the second outlet 16*c*, namely, a path to a refrigerating chamber side evaporator, but opens the first outlet 16*b*, namely, a path to a freezing chamber side evaporator. This may allow a refrigerant passing through the condenser 13 to flow only toward the first evaporator 14. However, the primary compressor 11 and the secondary compressor 12 are driven simultaneously. Accordingly, the refrigerant having passed through the first evaporator 14 is compressed sequentially, first via the primary compressor 11 and then second via the secondary compressor 12, as it is circulated.

In the refrigerating chamber driving mode, the refrigerant switching valve 16 closes the first outlet 16*b* but opens the second outlet 16*c*. And, the primary compressor 11 is stopped and the secondary compressor 12 is driven. Accordingly, refrigerant passing through the condenser 13 flows only toward the second evaporator 12. Therefore, the refrigerant is primarily-compressed in the secondary compressor 12 and then flows toward the condenser 13. These processes are repeatedly performed.

When the primary compressor 11 and the secondary compressor 12 are connected in series via the first refrigerant pipe 21 to perform a two-stage compression, oil within the primary compressor 11, which in this arrangement may function as a low-stage compressor, is discharged together with a refrigerant to be introduced into the secondary compressor 12, which in this arrangement may function as a high-stage compressor. Hence, in the primary compressor 11, an amount of oil collected may become larger than an amount of oil discharged, which may cause compression efficiency of the primary compressor 11 to be lowered and the primary compressor 11 to be damaged due to the lack of oil. Therefore, an oil balancing device for balancing oil between a secondary compressor functioning as a high-stage compressor and a primary compressor functioning as a low-stage compressor when such a plurality of compressors are connected in series to each other to perform a multi-stage compression of a refrigerant, and a method for effectively operating such an oil balancing device, will now be described.

Figure 3:
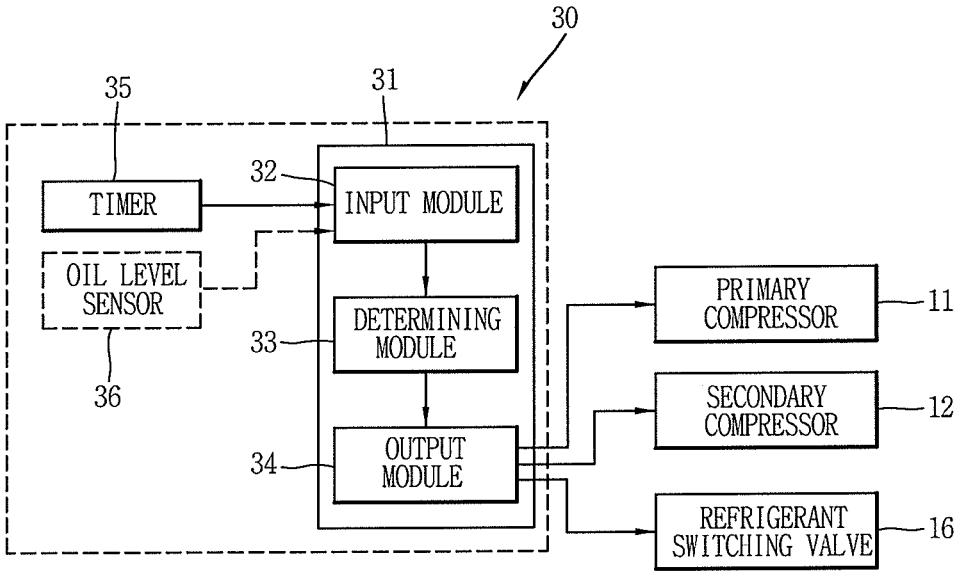
FIG. 3 is a block diagram of a controller for controlling a refrigerating cycle apparatus, in accordance with embodiments as broadly described herein.
Figure 4:
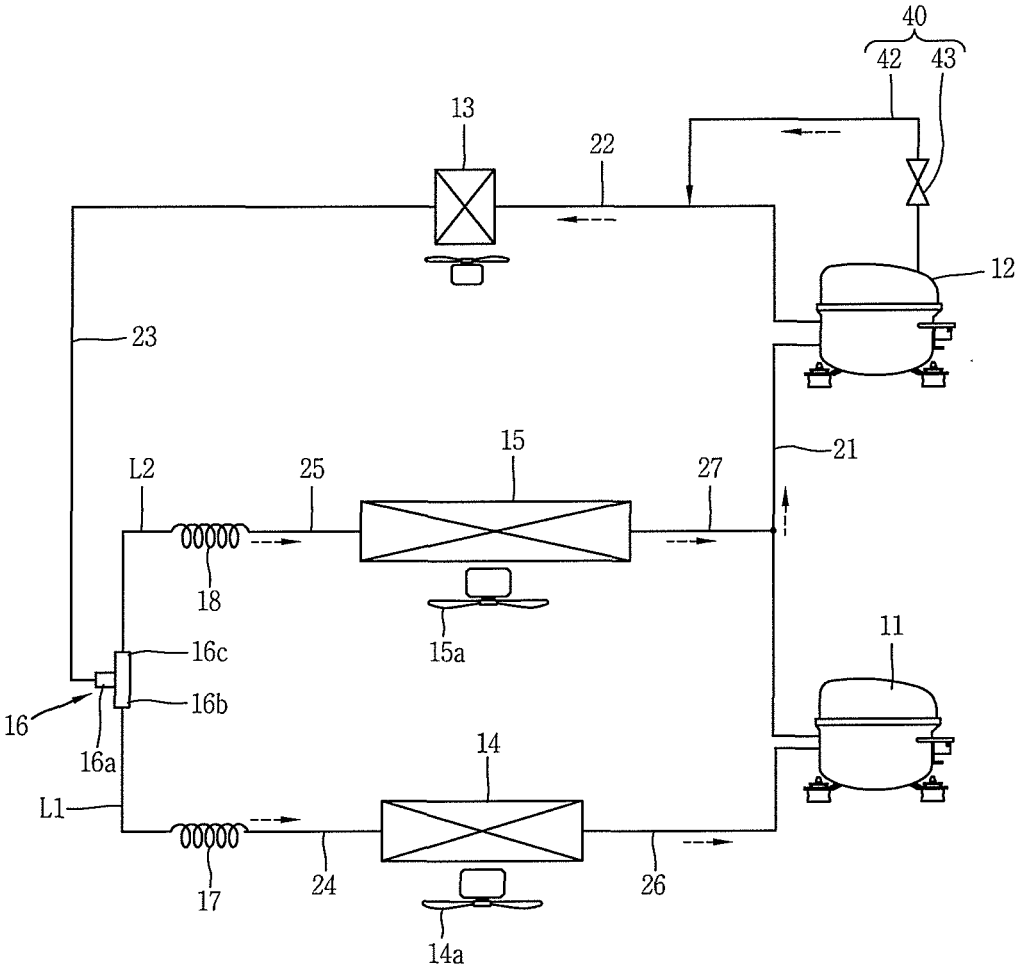
FIG. 4 is a view of a refrigerating cycle controlled by the controller shown in FIG. 3.

FIG. 3 is a block diagram of a controller for controlling a refrigerating cycle in accordance with embodiments as broadly described herein, and FIG. 4 is a schematic view of a refrigerating cycle controlled by the controller shown in FIG. 3.

As shown in FIGS. 3 and 4, an oil balancing device according to an exemplary embodiment may include a determination device 30 to determine whether or not oil has been concentrated in the secondary compressor 12, and an oil collection device 40 to execute an oil balancing operation between the primary compressor 11 and the secondary compressor 12 based on the determination result as determined by the determination device 30.

The determination device 30 may integrate a driving time of the secondary compressor 12 functioning as the high-stage compressor or the primary compressor 11 functioning as the low-stage compressor to determine whether or not oil has been concentrated in the secondary compressor 12, or detect an oil level of the secondary compressor 12 or the primary compressor 11 to determine whether or not oil has been concentrated in the secondary compressor 12.

For example, in order to determine an oil unbalance by integrating a driving time of a compressor, a timer 35 may be connected to a controller 31 for control of a refrigerator or a controller for control of a compressor (hereinafter, referred to as a micom). The micom 31, as shown in FIG. 3, may include an input module 32, a determining module 33 and an output module 34.

The input module 32 may be electrically connected to the timer 35 or an oil level sensor 36. The output module 34 may be electrically connected to the primary compressor 11, the secondary compressor 12 and the refrigerant switching valve 16 so as to control driving of each compressor 11 and 12 and a flowing direction of a refrigerant according to a determination made by the determining module 33.

The oil collection device 40 may include an oil collection pipe 42 installed to communicate with an inner space of a shell of the secondary compressor 12 so as to discharge oil collected in the inner space of the shell of the secondary compressor 12, and a non-return valve 43 installed at a middle portion of the oil collection pipe 42 to prevent oil from flowing from the second refrigerant pipe 22 back into the secondary compressor 12. The non-return valve 43 may be installed outside the shell of the secondary compressor 12, to prevent immersion of the valve 43 in oil and facilitate maintenance and repair thereof.

An inlet end of the oil collection pipe 42 may be inserted into the secondary compressor 12 to be at an appropriate oil level height of the secondary compressor 12, namely, a height corresponding to an amount of oil injected, which may prevent oil from being excessively discharged during an oil balancing process.

Here, more preferentially, the inlet end of the oil collection pipe 42 may be inserted to be positioned between a bottom surface of the inner space of the compressor and a height exceeding 20% of an amount of oil injected in the compressor, such that oil can be smoothly discharged in consideration of oil scattering generated in response to the compressor being inclined. In addition, considering the oil scattering, the oil collection pipe 42 may be more preferentially inserted by extending up to a center of the compressor.

Figure 5:
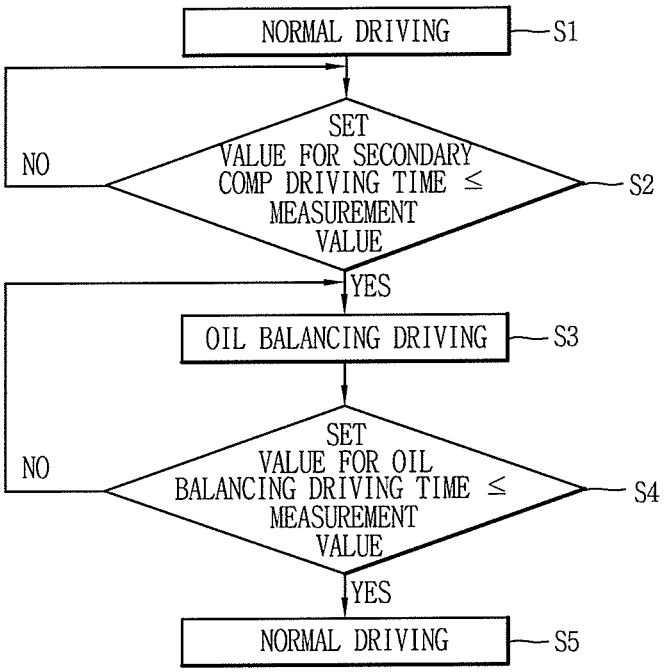
FIG. 5 is a flowchart of an exemplary embodiment for a driving algorithm of a refrigerating cycle, in accordance with embodiments as broadly described herein.

In the refrigerator having the refrigerating cycle with the configuration described above, oil concentrated in the secondary compressor 12 may be fed to the primary compressor 11 using the driving algorithm shown in FIG. 5.

As shown in FIG. 5, while a refrigerating cycle performs normal driving (S1), the timer 35 disposed in the micom 31 integrates a driving time of the secondary compressor 12 functioning as a high-stage compressor (S2). When the integrated driving time of the secondary compressor 12 exceeds a preset normal driving time, an oil balancing operation (mode) is started (S3).

During the oil balancing mode, the timer 35 integrates an oil balancing driving time (S4). When the integrated oil balancing driving time exceeds a preset oil balancing driving time, the driving mode of the secondary compressor 12 is switched back to the normal driving mode (S5). The series of processes are repeated.

The oil balancing driving process will be described with reference to FIG. 6. First, both of the primary compressor 11 and the secondary compressor 12 are turned off (stopped) (S11). Simultaneously, a pressure balancing process is carried out (S12). During the pressure balancing process, the first outlet 16*b* and the second outlet 16*c* of the refrigerant switching valve 16 are both open to balance pressure of the primary compressor 11 with pressure of the secondary compressor 12. Accordingly, oil which has been concentrated in the inner space of the shell of the secondary compressor 12 (at relatively high pressure) is discharged into the second refrigerant pipe 22, namely, into the refrigerating cycle via the oil collection pipe 42 due to pressure difference between the compressors (S13). The pressure balancing process may be carried out for about 5 minutes.

Figure 7:
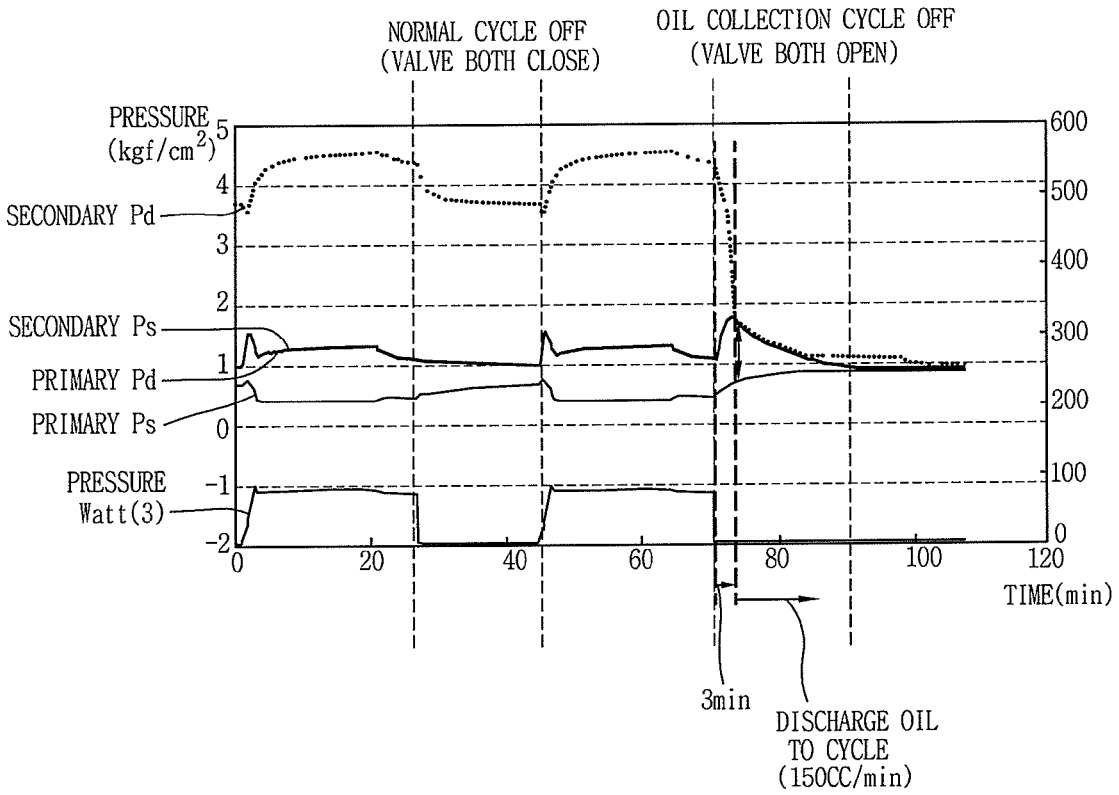
FIG. 7 is a graph of a pressure variation upon turning the refrigerating cycle off, for explaining an effect of the driving algorithm shown in FIG. 5.

FIG. 7 is a graph of a pressure variation upon turning the refrigerating cycle off for explaining an effect of the driving algorithm shown in FIG. 5. As shown in FIG. 7, a pressure variation is not so great when the refrigerating cycle is off (i.e., stopped) and both of the first outlet 16*b* and the second outlet 16*c* of the refrigerant switching valve 16 are closed (i.e., normal cycle off in FIG. 7). Discharge pressure of the secondary compressor 12 functioning as the high-stage compressor is not greatly reduced. However, when the driving is stopped with both of the first and second outlets 16*b* and 16*c* of the refrigerant switching valve 16 open (i.e., oil collection cycle off in FIG. 7), the discharge pressure of the secondary compressor 12 is remarkably reduced but suction pressure of the primary compressor 11 remarkably increases, which causes pressure reversal between the secondary compressor 12 and the primary compressor 11, allowing the oil to be quickly discharged from the secondary compressor 12 to the refrigerating cycle.

Next, the first outlet 16*b* of the refrigerant switching valve 16, which extends toward the primary compressor 11, is open, and the second outlet 16*c* of the refrigerant switching valve 16, which extends toward the secondary compressor 12, is closed. Simultaneously, an oil collection process of driving (running) both of the primary compressor 11 and the secondary compressor 12 is carried out (S13). Accordingly, the oil discharged into the refrigerating cycle is rapidly fed to the first evaporator 14 by the driving of the compressors 11 and 12 and thereafter introduced into the primary compressor 11, thereby preventing the lack of oil in the primary compressor 11. A fan installed in the machine chamber may be run to cool the condenser 13 so as to enhance efficiency of the refrigerating cycle.

When a preset oil balancing driving period comes during normal driving, the primary compressor 11 and the secondary compressor 12 may both be turned off and then the oil balancing may be executed after a preset time has elapsed, for example, after about 70 minutes. This may allow the oil balancing to be executed after sufficiently cooling an inside of the refrigerator. Also, when the oil balancing driving time is less than a preset time during pressure balancing, the pressure balancing and the oil collection may be simultaneously executed. In addition, when the oil balancing driving period comes during defrosting, the oil balancing may be executed after the defrosting is completed and then the refrigerating cycle is restarted, which may result in enhancement of the efficiency of the refrigerator.

The oil balancing driving period may be controlled based on a driving time of the secondary compressor 12 integrated using the timer 35. The oil balancing driving period may alternatively be controlled by using an oil level sensor, which is installed at each of the primary compressor 11 and the secondary compressor 12 or one of the two compressors. The oil level sensor 36 may be, for example, a floating type as shown in FIGS. 8A and 8B or a capacitance type as shown in FIG. 9.

Figure 8A:
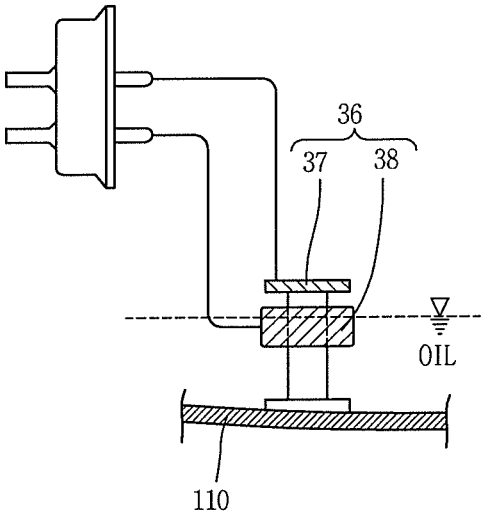
FIGS. 8A, 8B and 9 are front views of exemplary embodiments of an oil level sensor.
Figure 8B:
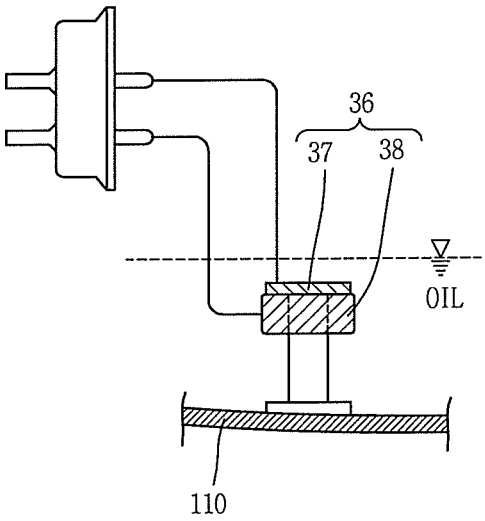

The floating type oil level sensor 36 of FIGS. 8A and 8B may be installed so that an anode plate 37 is fixed at an appropriate height from a lower surface 110 of a shell to serve as a fixed electrode, and an opposite cathode plate 38 is installed to be movable level between the bottom 110 of the shell and the anode plate 37 so as to serve as a movable electrode. Positions of the anode and cathode plates may be reversed. The floating type oil level sensor 36 may detect a height of the oil level as the cathode plate 38 is attached to or detached from the anode plate 37 as it moves up and down due to the level of oil. The cathode plate 38 functioning as the movable electrode may be formed of a material that floats easily on oil. If it is formed of a metal, a floating member such as an air bladder may be coupled to the cathode plate 38 as the movable electrode.

Figure 9:
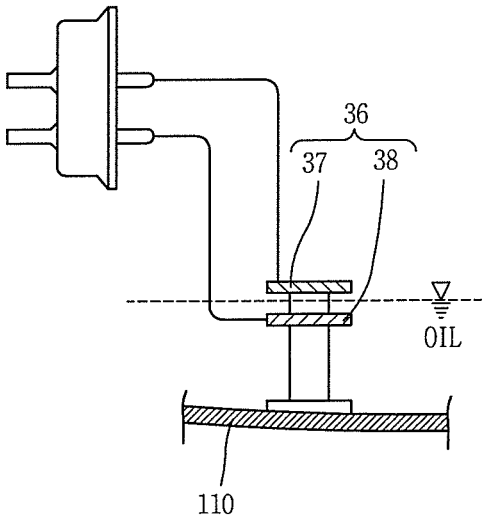

On the other hand, in the capacitance type oil level sensor 36 of FIG. 9, the anode plate 37 and the cathode plate 38 may together be implemented as the fixed electrode. Hence, the capacitance type oil level sensor 36 may detect a height of an oil level using differing capacitance value, based on whether or not oil is present between the anode plate 37 and the cathode plate 38.

The embodiment employing such an oil level sensor 36 is similar to the aforementioned embodiment employing the timer in view of the practice of actual oil balancing driving, however the oil level sensor 36 detects an oil level of the compressor so as to determine whether or not the oil balancing is required.

In a general driving condition, oil may be concentrated in the secondary compressor 12. Therefore, it may be possible to connect the inner space of the shell of the secondary compressor 12 to a discharge pipe of the secondary compressor 12 via an oil collection pipe (hereinafter, referred to as a high-stage oil collection pipe). However, in a hot condition in which an ambient temperature is higher than a normal driving condition, oil may be concentrated in the primary compressor 11. Considering this, an oil collection pipe (hereinafter, referred to as a low-stage oil collection pipe) 46 and a low-stage oil collection device 45 implemented as a non-return valve 47 may be installed between the inner space of the shell of the primary compressor 11 and the discharge pipe of the primary compressor 11.

Figure 10:
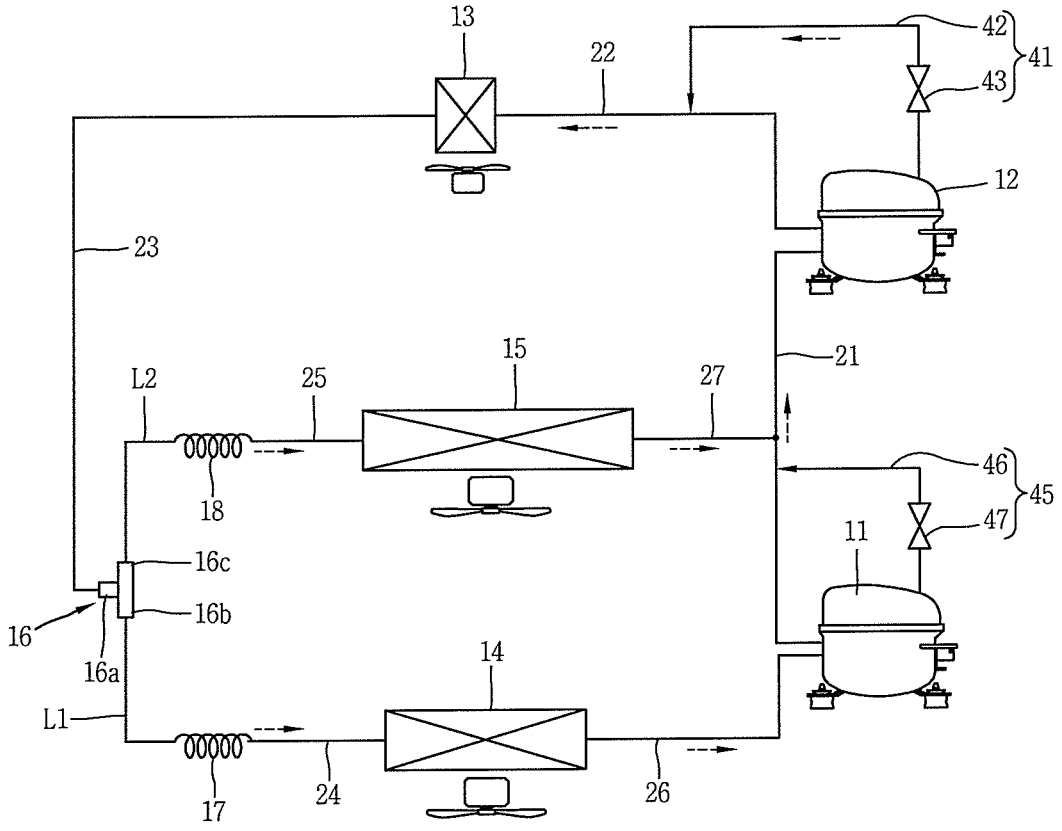
FIG. 10 is a schematic view of a refrigerating cycle having a high-stage oil collection unit and a low-stage oil collection unit in accordance with embodiments as broadly described herein.

FIG. 10 is a schematic view of a refrigerating cycle also having a high-stage oil collection device and a low-stage oil collection device.

As shown in FIG. 10, a high-stage oil collection device 41 may include a high-stage oil collection pipe 42 installed to communicate with the inner space of the shell of the secondary compressor 12 so as to discharge oil collected in the inner space of the shell of the secondary compressor 12, and a high-stage non-return valve 43 installed at a middle portion of the high-stage oil collection pipe 42 to prevent the oil from flowing from the second refrigerant pipe 22 back into the secondary compressor 12.

The low-stage oil collection device 45 may include a low-stage oil collection pipe 46 installed to communicate with the inner space of the shell of the primary compressor 11 so as to discharge oil collected in the inner space of the shell of the primary compressor 11, and a low-stage non-return valve 47 installed at a middle portion of the low-stage oil collection pipe 46 to prevent the oil from flowing from the first refrigerant pipe 21 back into the primary compressor 11.

In certain embodiments, inlet ends of the high-stage oil collection pipe 42 and the low-stage oil collection pipe 46 may be inserted into a secondary compressor 12, and the primary compressor 11 and positioned at appropriate oil level heights, namely, a height corresponding to an amount of oil injected, which may prevent oil from being excessively discharged while balancing oil. Accordingly, a height of the inlet end of the high-stage oil collection pipe 42 inserted into the secondary compressor 12 may be different from a height of the inlet end of the low-stage oil collection pipe 46 inserted into the primary compressor 11. For example, the high-stage oil collection pipe 42 may be inserted into the secondary compressor 12 so that the height of the inlet end thereof may be located farther away from the bottom of the shell of the secondary compressor 12 in which a relatively large amount of oil is injected. The low-stage oil collection pipe 46 may be inserted into the primary compressor 11 so that the height of the inlet end thereof may be located closer to the bottom of the shell of the primary compressor 11 containing a relatively small amount of oil.

In the refrigerator having a refrigerating cycle so configured, an oil balancing driving period may be controlled according to the aforementioned embodiment, namely, the algorithm shown in FIG. 5. This will not be described again in detail.

This exemplary embodiment may implement the algorithm shown in FIG. 5 so that the oil balancing driving for the secondary compressor 12 for collecting oil concentrated in the secondary compressor 12 to the primary compressor 11 may be carried out independent of the oil balancing driving for the primary compressor 11 for collecting oil concentrated in the primary compressor 11 to the secondary compressor 12. However, in certain circumstances, it may be beneficial to carry out the oil balancing for the secondary compressor 12 and the oil balancing for the primary compressor 11 in a consecutive manner, whereby an oil concentration into a compressor, which may occur under various conditions, may be prevented.

Figure 11:
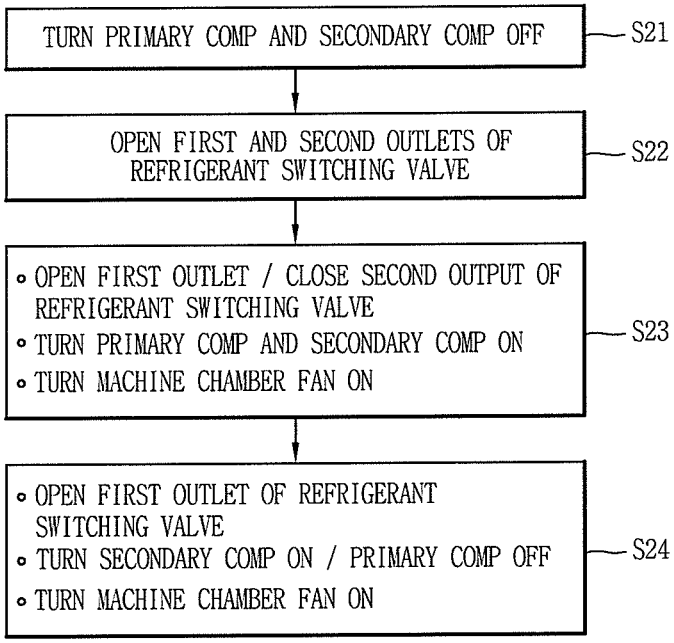
FIG. 11 is a flowchart of an oil balancing operation in which an algorithm for consecutively performing an oil balancing operation using the high-stage oil collection unit and the low-stage oil collection unit is applied, in accordance with embodiments as broadly described herein.

FIG. 11 is a block diagram of another exemplary embodiment of an oil balancing driving algorithm for consecutively performing oil balancing using the high-stage oil collection device and the low-stage oil collection device.

As shown in FIG. 11, after executing the oil balancing operation for the secondary compressor for a preset time (for example, about 5 minutes), the oil balancing operation for the primary compressor may be executed for a preset time (for example, about one and a half minutes).

Figure 6:
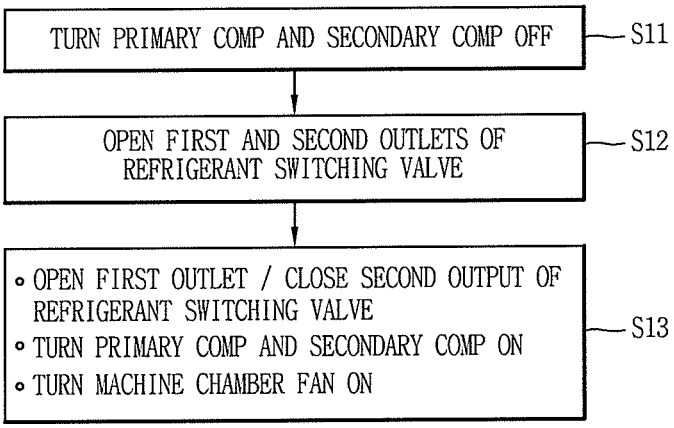
FIG. 6 is a block diagram of an exemplary embodiment of an oil balancing operation shown in FIG. 5.

First, the oil balancing for the secondary compressor may be executed according to sequential steps shown in FIG. 11, similar to the flowchart of FIG. 6. That is, the primary compressor 11 and the secondary compressor 12 are both turned off (stopped) (S21). Simultaneously, a pressure balancing process is executed, namely, the first outlet 16*b* and the second outlet 16*c* of the refrigerant switching valve 16 are both open to balance pressure of the primary compressor 11 with pressure of the secondary compressor 12 (S22). Accordingly, oil which has been concentrated in the inner space of the shell of the secondary compressor 12 of relatively high pressure is fed into the second refrigerant pipe 22, namely, into the refrigerating cycle via the high-stage oil collection pipe 42 due to pressure difference between the compressors 11 and 12. The pressure balancing process may be carried out for about 5 minutes.

Next, the first outlet 16*b* of the refrigerant switching valve 16 extending toward the primary compressor 11 is open and the second outlet 16*c* of the refrigerant switching valve 16 extending toward the secondary compressor 12 is closed. Simultaneously, an oil collection process of driving both of the primary and secondary compressors 11 and 12 is carried out (S23). Accordingly, oil discharged to the refrigerating cycle is quickly moved to the first evaporator 14 by the driving of the compressors 11 and 12 and then introduced into the primary compressor 11, thereby preventing a lack of oil in the primary compressor 11. A machine room fan installed in the machine chamber may cool the condenser 13 so as to enhance efficiency of the refrigerating cycle.

In a state in which the first outlet 16*b* extending toward the primary compressor 11 is open and the second outlet 16*c* extending toward the secondary compressor 12 is closed, the secondary compressor 12 is driven and the primary compressor 11 is turned off (S14). Accordingly, refrigerant discharged from the secondary compressor 12 is fed into the primary compressor 11 via the first outlet 16*b*, increasing pressure of in inner space of the primary compressor 11, and pushing out oil concentrated in the primary compressor 11. In turn, the oil concentrated in the primary compressor 11 is discharged into the first refrigerant pipe 21 via the low-stage oil collection pipe 46 and is introduced into the inner space of the shell of the secondary compressor 12 via the suction pipe of the secondary compressor 12, thereby achieving oil balancing between the primary compressor 11 and the secondary compressor 12.

The aforementioned embodiments have illustrated an oil collection pipe connected between the inner space of the shell and the discharge pipe of the secondary compressor or between the inner space of the shell and the discharge pipe of the primary compressor. Description will now be provided of an embodiment in which an oil collection pipe is connected directly between the primary compressor and the secondary compressor so as to allow for oil unbalancing between the compressors.

Figure 12:
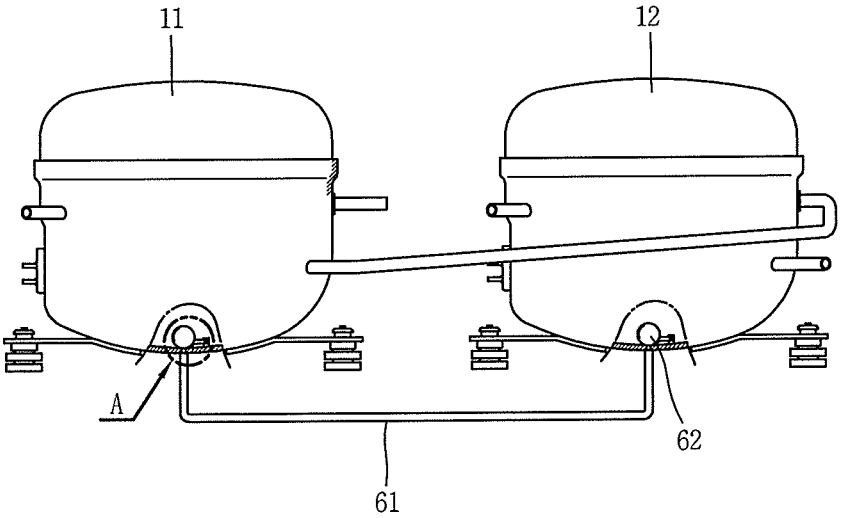
FIG. 12 is a front view of an oil collection passage in accordance with an embodiment as broadly described herein.

As shown in FIG. 12, an oil collection pipe 61 may connect an inside of the shell of the secondary compressor 12 to an inside of the shell of the primary compressor 11. In certain embodiments, the two ends of the oil collection pipe 61 may be respectively connected to a bottom of the shell of the secondary compressor 12 and a bottom of the shell of the primary compressor 11.

Figure 13:
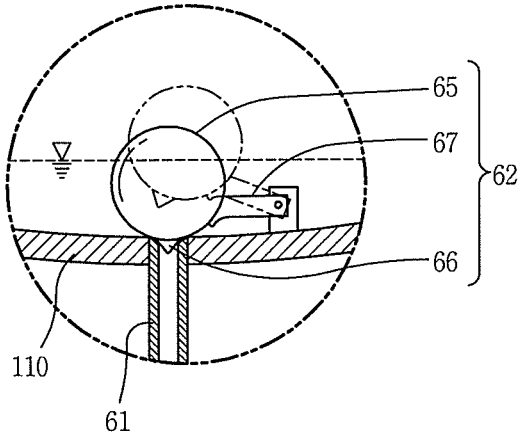
FIG. 13 is a front view of an oil collection valve of the oil collection passage shown in FIG. 12.

Oil collection valves 62 for selectively opening the oil collection pipe 61 may be installed at the two ends of the oil collection pipe 61. Each of the oil collection valves 62, as shown in FIG. 13, may include a bladder 65 which moves up and down according to an amount of oil, and a valve 66 coupled to the bladder 65 to open or close the corresponding end of the oil collection pipe 61.

The bladder 65 may be integrally coupled to a support 67, which may be rotatably coupled to the bottom of the shell of the respective compressor 11, 12, by a hinge. The valve 66 may be integrally formed or assembled with the bladder 65 or the support 67 to open or close an end of the oil collection pipe 61 while rotating together with the bladder 65 and/or the support 67. In certain embodiments, the valve 66 may be formed in a shape of a flat plate. Alternatively, it may be formed in a shape of a wedge to enhance a sealing force.

Figure 14:
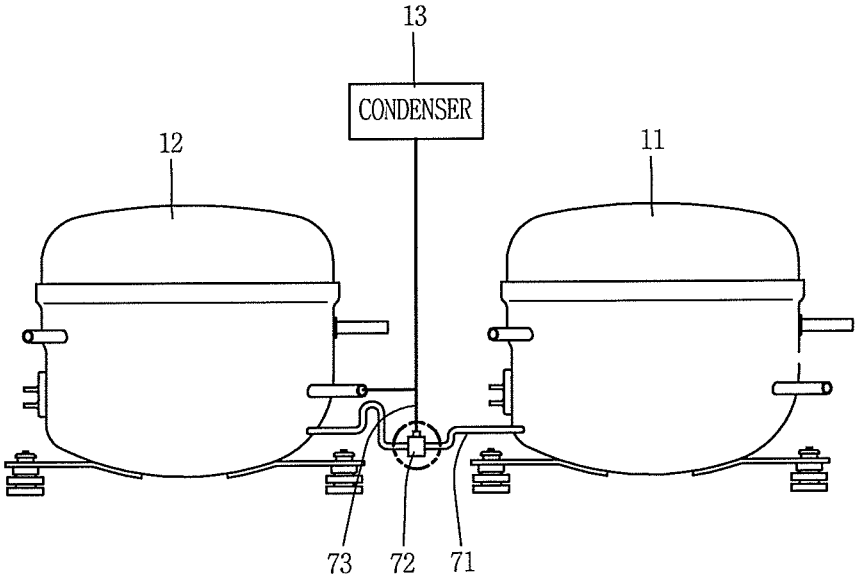
FIG. 14 is a front view of an oil collection passage in accordance with another embodiment as broadly described herein.

Alternatively, the oil collection valve 62 may be installed at an intermediate portion of the oil collection pipe 61, at the outside of the compressors. FIG. 14 is a front view of another exemplary embodiment of an oil collection passage, and FIG. 15 is a sectional view showing an operation of an oil collection valve of the oil collection passage shown in FIG. 14.

As shown in FIGS. 14 and 15, a valve space 71*a* in which a valve 72 is slidably accommodated may be formed at an intermediate portion of an oil collection pipe 71. An upper surface of the valve space 71*a* may be connected to the discharge pipe of the secondary compressor 12 or the primary compressor 11 via a gas guide pipe 73. An elastic member 72*a*, which elastically supports the valve 72, may be installed at a lower surface of the valve 72, namely, at a side thereof opposite the gas guide pipe 73 in the valve space 71*a*. A stopping surface 71*b* may protrude from or be stepped at an inner circumferential surface of the valve space 71*a* at a predetermined height, so as to allow the valve 72 to block the oil collection pipe 71 as the valve 72 moves down within the valve space 71*a*.

Figure 15A:
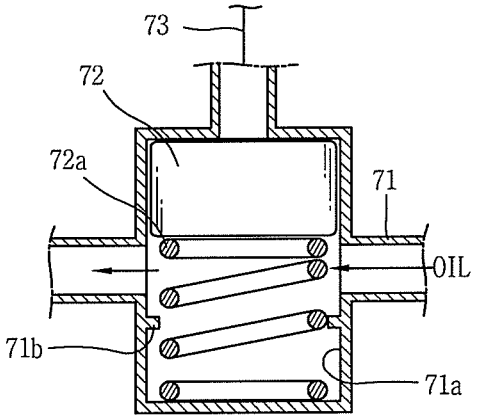
FIGS. 15A-15B are sectional views of an operation of the oil collection valve in the oil collection passage shown in FIG. 14.
Figure 15B:
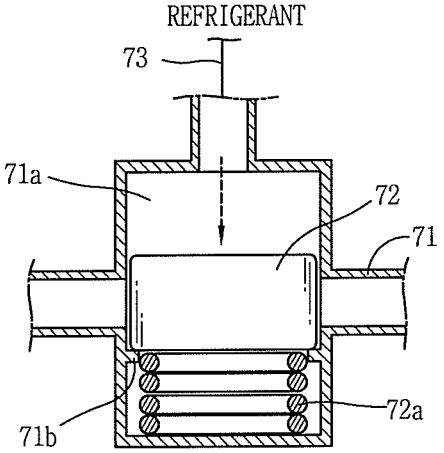

Given the configuration of the oil collection valve as shown in FIG. 15A, during compressor operation, a refrigerant of high pressure discharged via the discharge pipe of the corresponding compressor is introduced into the valve space 71*a* of the oil collection pipe 71 via the gas guide pipe 73. The high pressure presses refrigerant the valve 72 down so as to block the oil collection pipe 71, as shown in FIG. 15B. Consequently, pressure leakage between the compressors may be prevented, a pressure difference required for a two-stage compression may be maintained, and oil may remain in the shells of both of the compressors.

However, when the refrigerating cycle is shut down or performs low capacity driving, the valve 72 is moved up by an elastic force of the elastic member 72*a* to open the oil collection pipe 71 and return to the position shown in FIG. 15A. This allows the oil contained in the shells of the compressors to flow according to the inner pressure difference of the shells, thereby balancing oil between the compressors.

Figure 16:
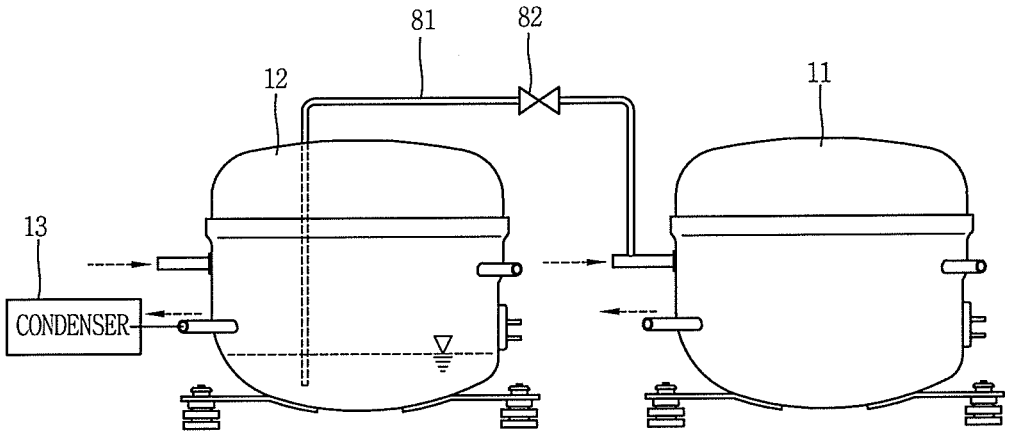
FIG. 16 is a front view of an oil collection passage in accordance another embodiment as broadly described herein.

As shown in FIG. 16, an oil collection pipe 81 may alternatively connect the inside of the shell of the secondary compressor to the suction pipe of the primary compressor. The oil collection pipe 81 may penetrate through the shell of the secondary compressor 12 to be connected to an intermediate portion of the suction pipe of the primary compressor 11. An oil collection valve 82 for selectively opening or closing the oil collection pipe 81 may be installed at an intermediate portion of the oil collection pipe 81. One end of the oil collection pipe 81 may extend all the way to a bottom of the shell of the compressor.

The oil collection valve 82 may be, for example, a solenoid valve which is electrically connected to the micom 31. Alternatively, the oil collection valve 82 may be as a check valve that allows oil to move only in one direction, from the secondary compressor 12 to the primary compressor 11, or a safe valve which is open when reaching a preset pressure. Other types of valves may also be appropriate.

Figure 17:
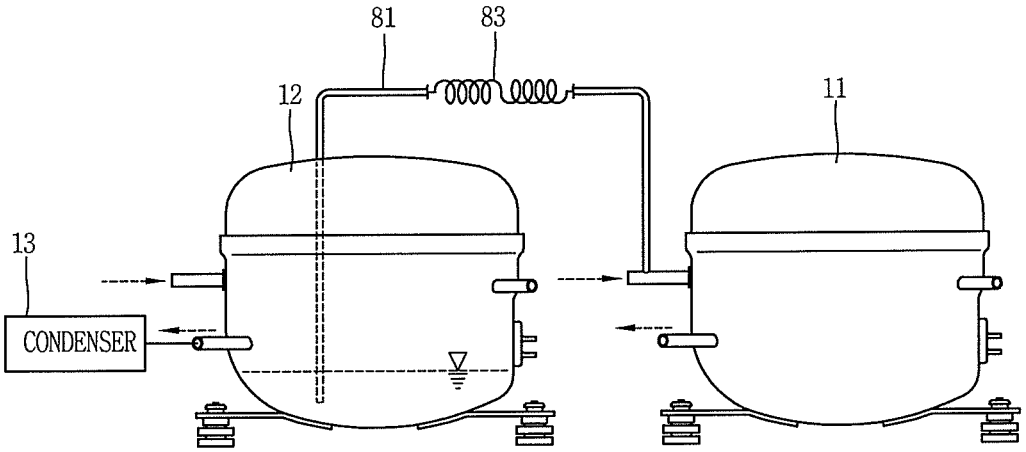
FIG. 17 is a front view of the oil collection passage shown in FIG. 16.

Alternatively, as shown in FIG. 17, a capillary 83 may instead be installed at an intermediate portion of the oil collection pipe 81. The capillary 83 may have relatively high flow resistance so as to prevent oil, which is discharged from the secondary compressor 12, from being easily moved toward the primary compressor 11. That is, although the capillary 83 does not fully block the flow through the oil collection pipe 81, the flow resistance through the capillary 83 slows the flow through the oil collection pipe 81 upon driving the refrigerating cycle.

Figure 18:
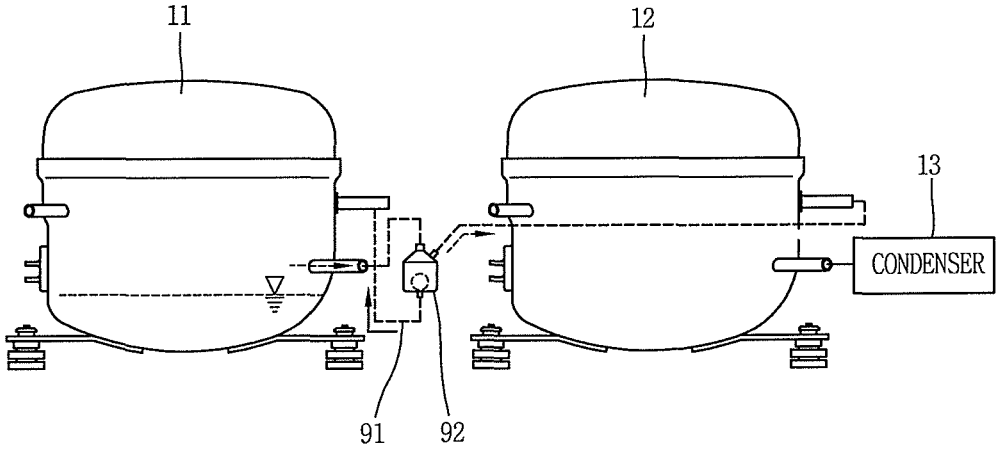
FIG. 18 is a front view of an oil collection passage in accordance with another embodiment as broadly described herein.

FIG. 18 is a front view of another exemplary embodiment in which an oil separator 92 is provided at an oil collection passage. As shown in FIG. 18, in this exemplary embodiment, an oil collection pipe 91 may be connected to a discharge pipe of the primary compressor 11 and a suction pipe of the secondary compressor 12. The oil separator 92 may be installed at an intermediate portion of the oil collection pipe 91. The oil separator 92 may separate oil from refrigerant which is discharged via the discharge pipe of the primary compressor 11, so that refrigerant gas (indicated with a dotted arrow) may be collected in the secondary compressor 12 and the separated oil (indicated with a solid arrow) may be collected in the primary compressor 11.

Figure 19:
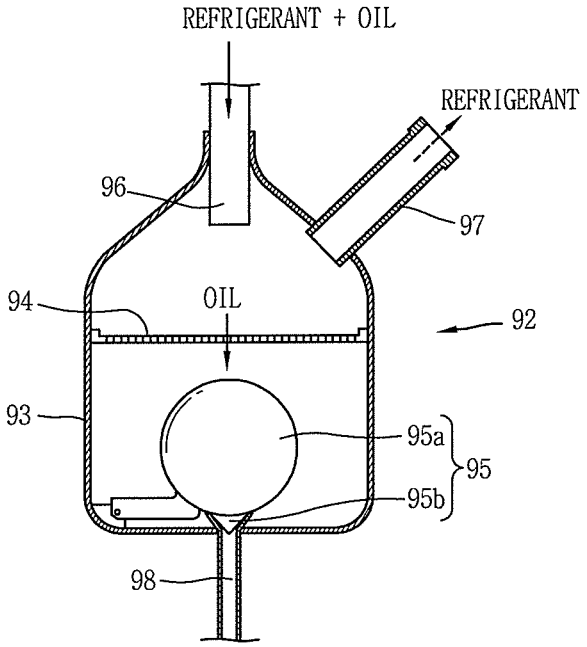
FIGS. 19 and 20 are sectional views of an oil separator applied to the oil collection passage of FIG. 18.

As shown in FIG. 19, the oil separator 92 may include a separation container 93 having a predetermined inner space, an oil separating net 94 disposed in the separation container 93 to separate oil from refrigerant, and an oil collection valve 95 to allow the oil separated through the oil separating net 94 to selectively flow toward the primary compressor 11.

The separation container 93 may include an inlet 96 connected to the discharge pipe of the secondary compressor 12 and located higher than the oil separating net 94, a first outlet 97 connected to the inlet of the condenser 13 and located at an upper portion of the separation container 93 (for example, higher than the oil separating net 94), and a second outlet 98 communicating with the inside of the shell of the primary compressor 11 and located lower than the oil separating net 94, namely, formed at a lower surface of the separation container 93.

Figure 20:
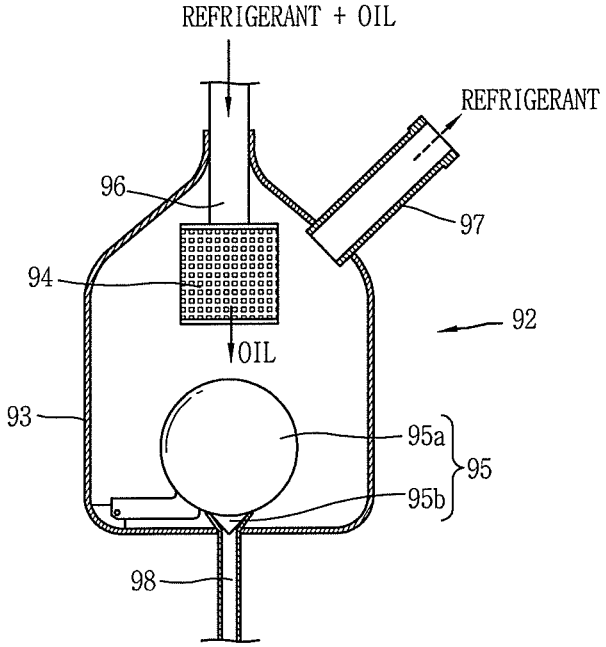

The oil separating net 94 may be horizontally installed at an intermediate height so as to partition the inner space of the separation container 93 into an upper part and a lower part. In certain embodiments, the inlet 96 and the first outlet 97 may communicate with the separation container 93 at positions higher than the oil separating net 94, and the second outlet 98 may communicate with the separation container 93 at a position lower than the oil separating net 94. In alternative embodiments, the oil separating net 94, as shown in FIG. 20, may be installed to cover the inlet 96 of the separation container 93. In this structure, the first outlet 97 may communicate with the upper part of the separation container 93, and the second outlet 98 may communicate with the lower part (e.g., the lower surface) of the separation container 93.

When such an oil separator is employed, a refrigerant discharged from the secondary compressor 12 toward the condenser 13 may be introduced into the separation container 93 of the oil separator 92. As the refrigerant passes through the oil separating net 94, oil is separated from the refrigerant. The separated oil may be collected on the bottom of the separation container 93. The refrigerant then flows toward the condenser 13 via the first outlet 97, whereas the separated oil, when a preset amount has been accumulated, may lift up a bladder 95*a* of the oil collection valve 95 to move a wedge-shaped valve 95*b* and open the second outlet 98. Accordingly, the oil is collected into the shell of the primary compressor 11 via the oil collection pipe 91.

As the oil separator may be directly connected between the compressors, the separated oil may be fully collected into the primary compressor without being left in the pipes of the refrigerating cycle. This may provide an enhanced oil collection effect and simplify associated pipe structure.

Figure 21:
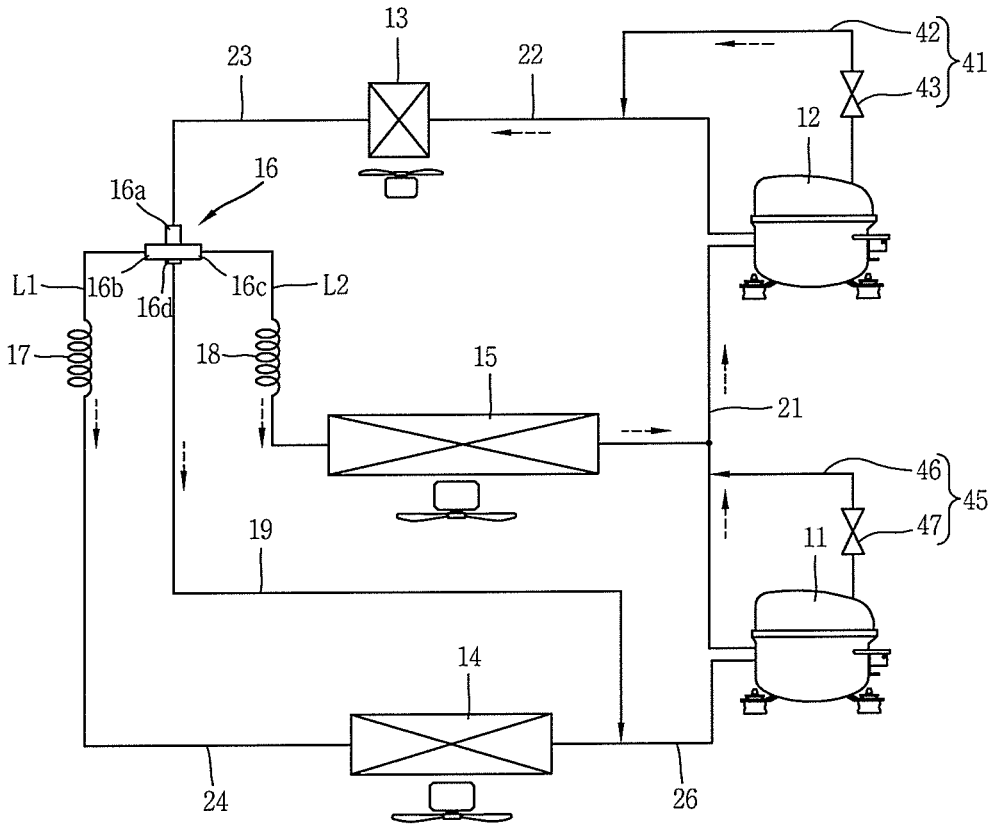
FIG. 21 is a schematic view of a 4-way refrigerant switching valve in the refrigerating cycle shown in FIG. 2.

The aforementioned embodiments have illustrated various driving algorithms using a three-way refrigerant switching valve. However, as shown in FIG. 21, such driving algorithms may be applied even when the refrigerant switching valve 16 is a four-way valve.

More specifically, the aforementioned embodiments have illustrated that the first outlet 16*b* of the refrigerant switching valve 16 is open when oil discharged into the cycle is directed toward the primary compressor 11 during oil balancing for the secondary compressor 12. However, this exemplary embodiment illustrates that oil may be directed toward the primary compressor 11 using a third outlet 16*d* of the refrigerant switching valve 16.

To this end, an oil guide pipe 19 may be connected to the third outlet 16*d* of the refrigerant switching valve 16. The oil guide pipe 19 may be connected between the outlet of the primary compressor 11 and the suction side of the primary compressor 11, namely, the sixth refrigerant pipe 26.

Accordingly, in a refrigerating cycle having a four-way refrigerant switching valve 16 and an oil guide pipe 19, according to the aforementioned algorithms, the first outlet 16*b* and the second outlet 16*c* of the refrigerant switching valve 16 are both closed and only the third outlet 16*d* connected with the oil guide pipe 19 is open. This allows oil within the refrigerating cycle to be collected into the primary compressor 11 via the refrigerant switching valve 16 and the oil guide pipe 19.

A refrigerator may employ a connection type reciprocal compressor, which generally converts a rotary motion of a motor into a linear motion, and a vibration type reciprocal compressor which makes use of a linear motion of the motor.

Such connection type and vibration type reciprocal compressors may function as a low-pressure type compressor whose discharge pipes are all connected directly to a discharge side of a compression part to allow a refrigerant discharged from the compression part to flow directly toward a condenser of a refrigerating cycle without passing through an inner space of a shell. Hence, such a low-pressure type compressor may use an oil collection pipe, such as the aforementioned oil collection pipe, to allow oil within the inner space of the shell to flow toward the refrigerating cycle.

However, a high-pressure type compressor whose discharge pipe communicates with an inner space of a shell may make use of a separate oil collection passage because the discharge pipe is generally located higher than an oil level. For example, a rotary compressor or a scroll compressor, which may be used in an air conditioner (in particular, a high-pressure type scroll compressor whose discharge pipe communicates with an inner space of a shell), may have a discharge pipe located higher than an oil level. Therefore, even in this case, the high-pressure type compressor may make use of an oil collection pipe for allowing oil within the inner space of the shell to flow into the refrigerating cycle.

Figure 22:
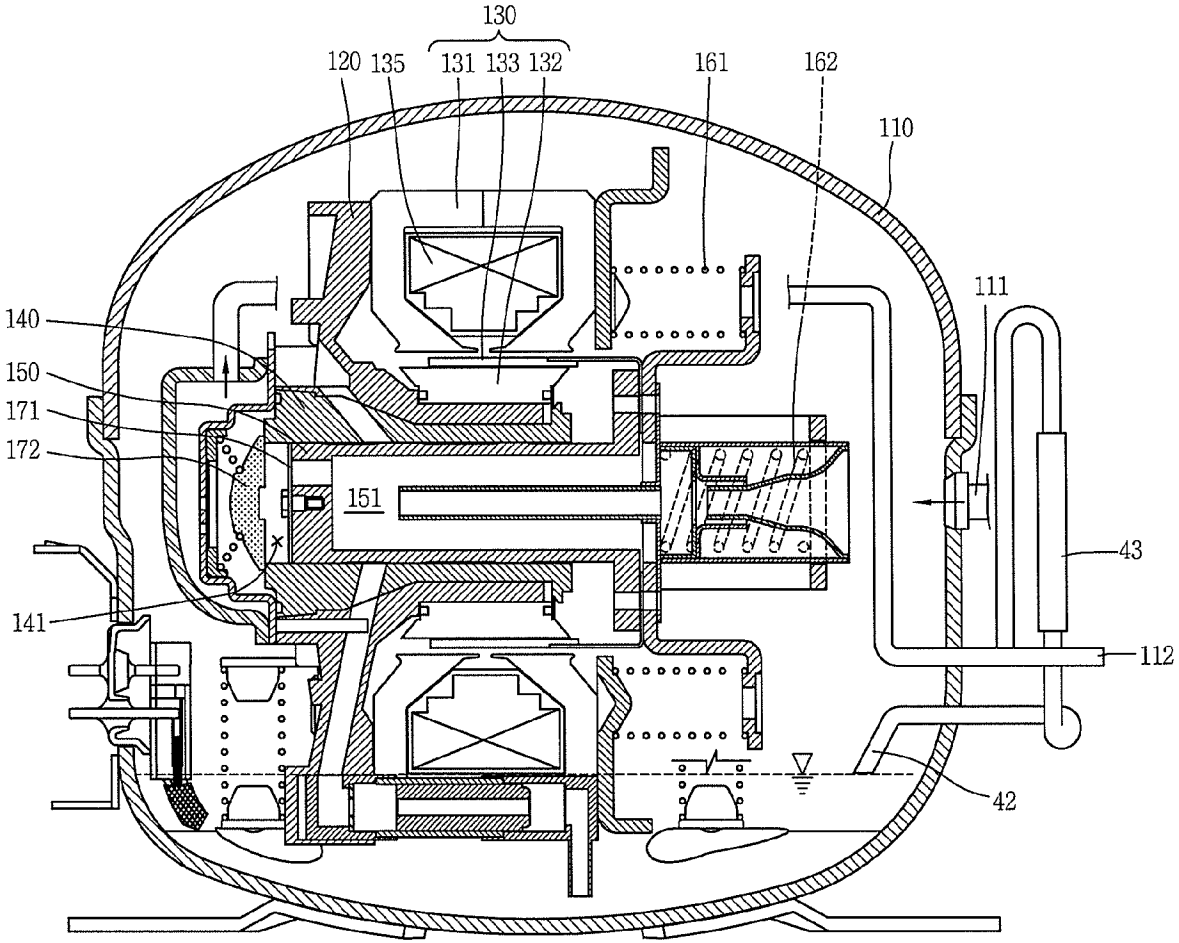
FIG. 22 is a sectional view of a secondary compressor having an oil collection passage in a refrigerating cycle apparatus in accordance with an embodiment as broadly described herein.

FIG. 22 is a sectional view of a secondary compressor having an oil collection passage in a refrigerating cycle apparatus, in accordance with an embodiment as broadly described herein.

As shown in FIG. 22, an exemplary secondary compressor may include a frame 120 elastically installed within an inner space of a hermetic shell 110, a reciprocal motor 130 including an outer stator 131, an inner stator 132, a mover 133 and a coil 135, and a cylinder 140 fixed to the frame 120, a piston 150 inserted in the cylinder 140 and coupled to the mover 133 of the reciprocal motor 130 so as to perform a reciprocal motion, and a plurality of resonance springs 161 and 162 installed at two opposite sides of the piston 150, in a motion direction, to induce a resonance motion of the piston 150.

The cylinder 140 may have a compression space 141, and the piston 150 may include a suction passage 151. A suction valve 171 for opening or closing the suction passage 151 may be installed at an end of the suction passage 151. A discharge valve 172 for opening or closing the compression space 141 of the cylinder 140 may be installed at an end surface of the cylinder 140.

A suction pipe 111 connected to a discharge pipe (not shown) of the primary compressor 11 may communicate with the inner space of the shell 110. A discharge pipe 112 which is connected to an inlet of the condenser 13 of the refrigerating cycle apparatus may communicate with one side of the suction pipe 111.

An oil collection pipe 42 may be inserted through a side of the shell 110 so as to communicate with the inner space. A non-return valve 43 for preventing oil from flowing back into the inner space of the shell 110 may be installed at the oil collection pipe 42.

One end of the oil collection pipe 42 may be connected to an intermediate portion of the discharge pipe 112 at the outside of the shell 110 of the secondary compressor 12, and the other end of the oil collection pipe 42 may be inserted through the shell 110 to extend to an appropriate oil level. A lower end of the oil collection pipe 42 may be curved toward the reciprocal motor in consideration of the shape of the shell 110. An oil flange for filtering impurities within the oil may be installed at a lower surface of the shell 110, which contacts the lower end of the oil collection pipe 42.

The non-return valve 43 may be, for example, a check valve or a safe valve which is automatically open when inner pressure of the shell 110 increases over a preset pressure level, or an electronic solenoid valve. When the non-return valve 43 is an electronic solenoid valve, the non-return valve 43 may be electrically connected to the micom 31 for controlling the refrigerating cycle so as to be associated with a driving state of the refrigerating cycle apparatus.

Alternatively, an oil collection pipe may be connected to a discharge pipe within the inner space of the shell 110 of the secondary compressor 12, and the non-return valve 43 may be installed within the inner space of the shell 110. In this type of structure, a space occupied by the refrigerating cycle may be reduced and pipes may be simplified.

When power is supplied to the coil 135 of the reciprocal motor 130, the mover 133 of the reciprocal motor 130 performs a reciprocal motion. In turn, the piston 150 coupled to the mover 133 linearly reciprocates within the cylinder 140 to draw a refrigerant in, which is discharged after undergoing primary compression in the primary compressor 11, into the shell via the suction pipe 111. The refrigerant within the inner space of the shell 110 is then introduced into the compression space 141 of the cylinder 140 via the suction passage 151 of the piston 150. The refrigerant introduced into the compression space 141 is discharged from the compression space 141 when the piston 150 moves forward, and flows toward the condenser 13 of the refrigerating cycle via the discharge pipe 112.

Referring back to FIG. 4, as oil is discharged together with the refrigerant from the primary compressor 11 to flow into the shell 110 of the secondary compressor 12, the secondary compressor 12 may contain more oil while the primary compressor suffers from a lack of oil due to the aforementioned discharge of oil. However, in the refrigerating cycle according to the exemplary embodiment, the aforementioned driving algorithms may be employed to cause the oil concentrated in the secondary compressor 12 to flow into the primary compressor 11 so as to balance an amount of oil between the primary compressor 11 and the secondary compressor 12, thereby improving performance of the refrigerating cycle as well as efficiency and reliability of the compressors.

The oil contained in the inner space of the shell 110 of the secondary compressor 12 may be guided into the discharge pipe 112 via the oil collection pipe 42 for connecting the inner space of the shell 110 to the outside, thereby being introduced into the refrigerating cycle.

In the aforementioned embodiment, while balancing pressure between both compressors by opening the refrigerant switching valve with the primary and secondary compressors turned off, the oil within the secondary compressor may be discharged into the refrigerating cycle. Afterwards, both of the compressors may be turned on to collect oil, which has been discharged into the refrigerating cycle, into the primary compressor, or the secondary compressor may be turned on to collect oil of the primary compressor into the secondary compressor. In the following exemplary embodiment, oil of the secondary compressor is collected into the primary compressor by increasing pressure of the secondary compressor.

In certain embodiments, increasing pressure within the shell of the secondary compressor may be realized by a method using a separate pressing device, and a method using a driving algorithm of a refrigerating cycle.

That is, in certain embodiments, a pressurizer may communicate with the inside of the shell of the secondary compressor, and be driven, if necessary, to increase inner pressure of the shell of the secondary compressor up to a preset pressure. On the contrary, in the method using the driving algorithm of the refrigerating cycle, the primary compressor may be turned on, or the primary compressor and secondary compressors may be simultaneously turned on, to allow a refrigerant discharged from the primary compressor to be introduced into the secondary compressor, thereby increasing inner pressure of the shell of the secondary compressor up to a preset pressure.

As such, when pressure of the secondary compressor increases, the oil contained in the shell of the secondary compressor may rapidly flow to the refrigerant pipe or the primary compressor of the refrigerating cycle. In particular, when the oil flows from the shell of the secondary compressor to the refrigerant pipe of the refrigerating cycle, a method for collecting the oil into the primary compressor may be implemented by the following driving algorithm.

Figures 23, 24:
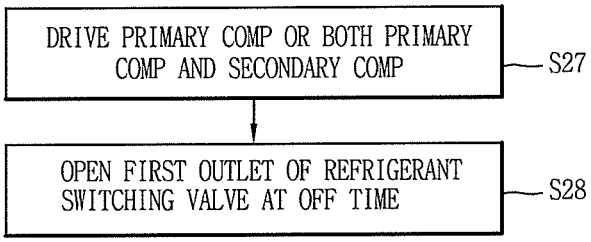
FIG. 23 is a flowchart of a driving algorithm of a refrigerating cycle in accordance with an embodiment as broadly described herein.
FIG. 24 is a table of test results for changes in an amount of oil in a primary compressor and in a secondary compressor when the driving algorithm shown in FIG. 23 is applied to a vibration type reciprocal compressor.

FIG. 23 is flowchart of another exemplary embodiment of a driving algorithm of a refrigerating cycle as broadly described herein.

As shown in FIGS. 2 and 23, when the refrigerating cycle is turned off (i.e., at an off time), the low-stage primary compressor 11 may be driven individually or together with the high-stage secondary compressor 12. Accordingly, the inner pressure of the shell of the secondary compressor 12 increases (S27).

When the refrigerating cycle is turned off, the first outlet 16*b* of the refrigerant switching valve 16 is open for a preset time. Oil contained in the secondary compressor 12 is then discharged together with a refrigerant to be collected in the primary compressor 11 (S28).

The driving algorithm of the refrigerating cycle may allow oil to be rapidly discharged from the secondary compressor into the refrigerating cycle by increasing the inner pressure of the shell of the secondary compressor, even without a separate pressurizing member. Also, the driving algorithm may allow the discharged oil to be introduced into the primary compressor so as to effectively maintain an amount of oil within each compressor.

FIG. 24 is a table of test results for changes in an amount of oil in a primary compressor and a secondary compressor when the driving algorithm shown in FIG. 23 is applied to a vibration type reciprocal compressor. This shows the results obtained by executing an oil collection once every 12 hours.

As shown in FIG. 24, when the primary compressor 11 is driven to the maximum stroke (i.e., driven to reach Top Dead Center (TDC)) and the secondary compressor 12 is turned off, an oil level of the primary compressor 11 increases from 43.8 mm up to 45.5 mm and the oil level of the secondary compressor 12 increases from 58 mm up to 60 mm. Additionally, when the oil collection driving is continued for 30 minutes, an amount of oil in the primary compressor 11 increases by 5.9 cc and an amount of oil in the secondary compressor 12 increases by 8 cc.

Further, as both of the primary compressor 11 and the secondary compressor 12 are driven to the maximum stroke (i.e., driven to reach TDC), the oil level of the primary compressor 11 increases from 42.3 mm up to 44.5 mm and the oil level of the secondary compressor 12 increases from 60 mm up to 62 mm. In addition, when the oil collection driving is continued for 30 minutes, the amount of oil in the primary compressor 11 increases by 7.5 cc and the amount of oil in the secondary compressor increases by 8 cc.

Accordingly, a considerable amount of oil may be introduced into the primary compressor as well as the secondary compressor, thereby preventing the lack of oil in advance.

Figures 25, 26:
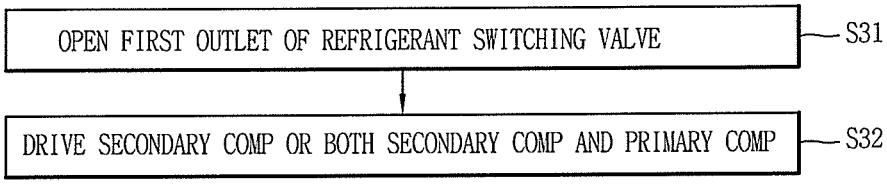
FIG. 25 is a flowchart of a driving algorithm of a refrigerating cycle in accordance with an embodiment as broadly described herein.
FIG. 26 is a table of test results for changes in an amount of oil in a primary compressor and a secondary compressor when the driving algorithm shown in FIG. 25 is applied to a vibration type reciprocal compressor.

An oil collection driving operation may be forcibly carried out for a preset time while the refrigerating cycle is driven, to introduce oil into the primary compressor. FIG. 25 is a flowchart of another exemplary embodiment of a driving algorithm of a refrigerating cycle.

As shown in FIGS. 2 and 25, the second outlet 16*c* of the refrigerant switching valve 16 is closed and the first outlet 16*b* is open (S31).

The secondary compressor 12 of the refrigerating cycle is driven up to the maximum stroke (i.e., reaching TDC) for a preset time, or both the primary compressor 11 (in a normal driving mode in which a stroke is 4.5 mm) and the secondary compressor 12 (in a maximum driving mode, namely, reaching TDC) are simultaneously driven (S32). Accordingly, the inner pressure of the shell of the secondary compressor 12 continuously increases so that oil can be discharged into the refrigerating cycle. The oil discharged into the refrigerating cycle is collected into the primary compressor 11. Here, as the secondary compressor 12 is driven to reach TDC and the primary compressor is driven in the normal mode when the primary and secondary compressors 11 and 12 are simultaneously driven, discharge pressure of the secondary compressor 12 (as the high-stage compressor) increases and accordingly the oil within the refrigerating cycle may flow smoothly into the primary compressor (as the low-stage compressor).

FIG. 26 is a table showing test results for changes in an amount of oil in a primary compressor and a secondary compressor when the driving algorithm shown in FIG. 25 is applied to a vibration type reciprocal compressor. This shows the results obtained by executing an oil collection once every 12 hours, as shown in the aforementioned embodiment.

As shown in FIG. 26, when the primary compressor 11 is turned off and the secondary compressor 12 is driven up to the maximum stroke (i.e., driven to reach TDC), the oil level of the primary compressor increases from 61 mm to 62.5 mm and the oil level of the secondary compressor 12 decreases from 47 mm down to 42.5 mm. When the oil collection driving is continued for 60 minutes, the amount of oil in the primary compressor increases by 6 cc and the amount of oil in the secondary compressor decreases by 18 cc.

Further, when the primary compressor is driven in the normal driving mode (i.e., stroke is 4.5 mm) and the secondary compressor 12 is driven up to the maximum stroke (i.e., driven to reach TDC), the oil level of the primary compressor 11 increases from 62 mm to 62.8 mm and the oil level of the secondary compressor 12 decreases from 45 mm to 44 mm. In addition, when the oil collection driving is continued for 60 minutes, the amount of oil in the primary compressor 11 increases by 3 cc and the amount of oil in the secondary compressor 12 decreases by 4 cc.

Consequently, it can be understood that the oil discharged from the secondary compressor can be introduced into the primary compressor, which may prevent a lack of oil in the primary compressor where the relative decrease of the amount of oil is concerned.

Figures 27, 28:
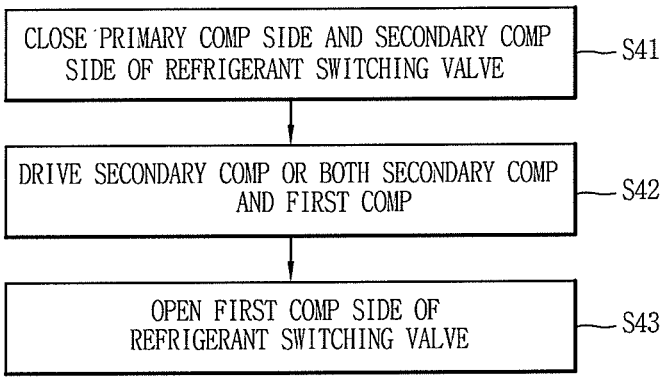
FIG. 27 is a flowchart of a driving algorithm of a refrigerating cycle in accordance with an embodiment as broadly described herein.
FIG. 28 is a table of test results for changes in an amount of oil in a primary compressor and a secondary compressor when the driving algorithm shown in FIG. 27 is applied to a vibration type reciprocal compressor.

FIG. 27 is a flowchart of another exemplary embodiment of a driving algorithm of a refrigerating cycle, and FIG. 28 is a table showing test results for changes in an amount of oil in a primary compressor and a secondary compressor when the driving algorithm shown in FIG. 27 is applied to a vibration type reciprocal compressor. This shows the results obtained by executing an oil collection once every 12 hours.

As shown in FIGS. 2 and 27, the first outlet 16*b* and the second outlet 16*c* of the refrigerant switching valve 16 are both closed (S41).

The secondary compressor 12 of the refrigerating cycle is individually driven up to the maximum stroke (i.e., driven to reach TDC) for a preset time, or both of the primary compressor 11 (in a normal driving mode that a stroke is 4.5 mm) and the secondary compressor (reaching TDC) are simultaneously driven for a preset time (S42). Accordingly, the inner pressure of the shell of the secondary compressor 12 continuously increases.

The first outlet 16*b* of the refrigerant switching valve 16 is open for a preset time (S43). Oil within the secondary compressor 12 is discharged together with a refrigerant to be collected in the primary compressor 11.

As shown in FIG. 28, when the primary compressor 11 is turned off and the secondary compressor 12 is driven up to the maximum stroke (i.e., reaching TDC), the oil level of the primary compressor 11 increases from 49.8 mm to 50 mm and the oil level of the secondary compressor 12 decreases from 54.5 mm to 54 mm. When the oil collection driving is continued for 15 minutes, the amount of oil in the primary compressor 11 increases by 1 cc and the amount of oil in the secondary compressor decreases by 3 cc.

Additionally, when the primary compressor 11 is driven in the normal driving mode (i.e., stroke is 4.5 mm) and the secondary compressor 12 is driven up to the maximum stroke (i.e., reaching TDC), the oil level of the primary compressor 11 increases from 53.5 mm to 53.8 mm and the oil level of the secondary compressor 12 decreases from 49.8 mm to 49.5 mm. In addition, when the oil collection driving is continued for 15 minutes, the amount of oil in the primary compressor 11 increases by 0.5 cc and the amount of oil in the secondary compressor 12 decreases by 1 cc.

Consequently, the oil discharged from the secondary compressor may be introduced into the primary compressor, which may prevent a lack of oil of the primary compressor where the relative decrease of the amount of oil is concerned.

Figure 29:
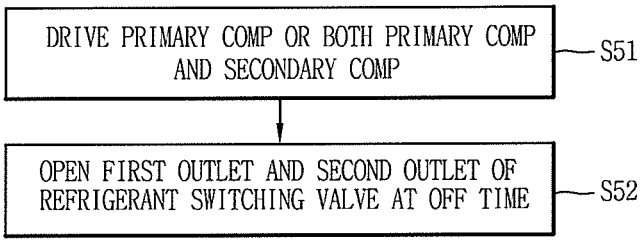
FIG. 29 is a flowchart of a driving algorithm of a refrigerating cycle in accordance with an embodiment as broadly described herein.

While balancing pressure of a refrigerant by opening both of the outlets 16*b* and 16*c* of the refrigerant switching valve 16 for a preset time upon the refrigerating cycle being turned off, the oil may be collected into the primary compressor. FIG. 29 is a flowchart of another exemplary embodiment of a driving algorithm of a refrigerating cycle.

As shown in FIG. 29, the primary compressor 11 is turned on individually or driven together with the secondary compressor 11 upon the refrigerating cycle being turned off, thus increasing the inner pressure of the shell of the secondary compressor 12 (S51).

When the refrigerating cycle is turned off, both of the first outlet 16*b* and the second outlet 16*c* of the refrigerant switching valve 16 are open for a preset time (S52). Accordingly, the oil is discharged from the secondary compressor together with the refrigerant to flow toward the first evaporator 14 and the second evaporator 15. However, since pressure of the second evaporator 15 is higher than that of the first evaporator 14, more oil flows toward the first evaporator 14 for balancing pressure, thereby being collected in the primary compressor 11. The operation effect according to this algorithm is similar to the algorithm shown in FIG. 23.

The foregoing embodiments and advantages are merely exemplary and are not to be construed as limiting. The present teachings may be readily applied to other types of apparatuses. This description is intended to be illustrative, and not to limit the scope of the claims. Many alternatives, modifications, and variations will be apparent to those skilled in the art. The features, structures, methods, and other characteristics of the exemplary embodiments described herein may be combined in various ways to obtain additional and/or alternative exemplary embodiments.

A refrigerating cycle apparatus and method are provided that are capable of preventing beforehand a frictional loss or an increase in power consumption caused due to a lack of oil in a compressor, by running a refrigerating cycle, which has a plurality of compressors, in a state that avoids oil being concentrated in one compressor.

A refrigerating cycle apparatus having a plurality of compressors and a method of operating the same are provided in which a device and pipes for overcoming oil unbalancing between the compressors are simplified in structure so that the device may occupy a smaller space in the refrigerating cycle apparatus, and flow resistance of air may be reduced by the simplification of the pipes so as to enhance cooling efficiency for a condenser.

A refrigerating cycle apparatus as embodied and broadly described herein may include a plurality of compressors each containing a preset amount of oil, the apparatus including a determination device configured to determine whether or not oil has been concentrated in one of the plurality of compressors, and an oil collection device configured to perform an oil balancing by a pressure difference between the plurality of compressors according to the determination result by the determination device.

A method of operating a refrigerating apparatus embodied and broadly described herein, the refrigerating cycle apparatus having a low-stage compressor and a high-stage compressor connected to each other in series, a refrigerant switching valve connected to a discharge side of the high-stage compressor, the refrigerant switching valve including a low-stage side outlet connected to a low-stage side evaporator and a high-stage side outlet connected to a high-stage side evaporator, the low-stage side evaporator connected to a suction side of the low-stage compressor and the high-stage side evaporator connected to a suction side of the high-stage compressor, may include determining whether or not an oil balancing is required between the low-stage compressor and the high-stage compressor, and performing the oil balancing so as to feed oil from a compressor containing more oil to a compressor containing less oil when it is determined to perform the oil balancing.

A refrigerating cycle apparatus as embodied and broadly described herein may include a primary compressor, a secondary compressor having a suction side connected to a discharge side of the primary compressor, a condenser connected to a discharge side of the secondary compressor, a refrigerant switching valve installed at an outlet side of the condenser, a first evaporator connected to a first outlet of the refrigerant switching valve and connected to a suction side of the primary compressor, a second evaporator connected to a second outlet of the refrigerant switching valve and connected to the suction side of the secondary compressor by joining with the discharge side of the primary compressor, and a control unit configured to control driving of the first and secondary compressors and simultaneously control an opening direction of the refrigerant switching valve so as to allow oil within the secondary compressor to flow to the primary compressor.

Any reference in this specification to "one embodiment," "an embodiment," "example embodiment," etc., means that a particular feature, structure, or characteristic described in connection with the embodiment is included in at least one embodiment of the invention. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A method for operating a refrigerating cycle apparatus having a low-stage compressor and a high-stage compressor connected to each other in series, and a refrigerant switching valve connected to a discharge side of the high-stage compressor and having a low-stage side outlet connected to a low-stage side evaporator and a high-stage side outlet connected to a high-stage side evaporator, with the low-stage side evaporator connected to a suction side of the low-stage compressor and the high-stage side evaporator connected to a suction side of the high-stage compressor, the method comprising:

determining that oil balancing is required between the low-stage compressor and the high-stage compressor; and performing an oil balancing operation and transferring oil from one of the low-stage or the high-stage compressor to the other of the low-stage or the high-stage compressor, the one of the low-stage or the high-stage compressor containing more oil than the other of the low-stage or the high-stage compressor, wherein the performing of the oil balancing operation comprises driving the high-stage compressor or both compressors for a predetermined period of time, with at least the low-stage side outlet of the refrigerant switching valve closed, and wherein the performing of the oil balancing operation further comprises, after driving the low-stage compressor or both compressors, opening the refrigerant switching valve toward the low-stage side evaporator.

2. The method of claim 1, wherein the performing of the oil balancing operation further comprises, before driving the high-stage compressor or both compressors, opening at least one of the low-stage side outlet or the high-stage side outlet of the refrigerant switching valve for a predetermined period of time, with at least one of the low-stage compressor or the high-stage compressor turned off.

3. A method for operating a refrigerating cycle apparatus having a low-stage compressor and a high-stage compressor connected to each other in series, and a refrigerant switching valve connected to a discharge side of the high-stage compressor and having a low-stage side outlet connected to a low-stage side evaporator and a high-stage side outlet connected to a high-stage side evaporator, with the low-stage side evaporator connected to a suction side of the low-stage compressor and the high-stage side evaporator connected to a suction side of the high-stage compressor, the method comprising:

determining that oil balancing is required between the low-stage compressor and the high-stage compressor; and performing an oil balancing operation and transferring oil from one of the low-stage or the high-stage compressor to the other of the low-stage or the high-stage compressor, the one of the low-stage or the high-stage compressor containing more oil than the other of the low-stage or the high-stage compressor, wherein the performing of the oil balancing operation comprises driving the low-stage compressor or both compressors for a predetermined period of time, with at least the low-stage side outlet of the refrigerant switching valve closed, and wherein the performing of the oil balancing operation further comprises, after driving the low-stage compressor or both compressors, opening the refrigerant switching valve toward the low-stage side evaporator.

4. The method of claim 3, wherein the performing of the oil balancing operation further comprises, before driving the low-stage compressor or both compressors, opening both the low-stage side outlet and the high-stage side outlet of the refrigerant switching valve for a predetermined period of time, with the low-stage compressor and the high-stage compressor turned off, so as to discharge oil from the one of the compressors containing more oil to the other of the compressors containing less oil.

5. A refrigerating cycle apparatus having a plurality of compressor each configured to receive a respective predetermined amount of oil, the apparatus comprising:

a controller having a determination device configured to determine whether an amount of oil accumulated in one of the plurality of compressors exceeds its respective predetermined value, and to control oil to be transferred from a compressor containing more oil to another compressor containing less oil of the plurality of compressors, wherein the controller controls at least one of the discharge sides of the plurality of compressors to be open, by opening at least one valve located between the at least one of the discharge sides and a suction side of the compressors, for a predetermined period of time in a stopped state of the refrigerating cycle, and thereafter restarts at least one of the plurality of compressors to collect oil into a compressor containing less oil in response to a determination made by the determination device, wherein the controller restarts the one of the plurality of compressors while at least one of suction sides of the plurality of compressors is open, by opening the at least one valve.

6. A refrigerating cycle apparatus, comprising:

a primary compressor;

a secondary compressor having a suction side thereof connected to a discharge side of the primary compressor;

a condenser connected to a discharge side of the secondary compressor;

a first evaporator connected to a suction side of the primary compressor;

a second evaporator connected to the suction side of the secondary compressor;

at least one first valve configured to provide selective communication between an outlet side of the condenser, and the suction side of the primary compressor or the suction side of the secondary compressor; and a controller configured to control operation of the primary and secondary compressors and simultaneously control the at least one first valve so as to allow oil within the secondary compressor to flow to the primary compressor, wherein the controller opens at least one of discharge sides of the plurality of compressors, by opening at least one valve located between the at least one of the discharge sides and a suction side of the compressors, for a predetermined period of time in a stopped state of the refrigerating cycle, and thereafter restarts at least one of the plurality of compressors to collect oil into a compressor containing less oil in response to a determination made by a determination device.

7. The refrigerator cycle apparatus of claim 6, wherein the controller restarts one of the plurality of compressors while at least one of the suction sides of the plurality of compressors is open, by opening the at least one valve.

8. The refrigerating cycle apparatus of claim 6, wherein an oil collection pipe is connected between an inner space of the primary compressor and an inner space of the secondary compressor, and wherein a valve assembly to open and close the oil collection pipe is installed at an intermediate portion of the oil collection pipe.

9. The refrigerating cycle apparatus of claim 8, wherein the valve assembly is connected to the discharge side of the primary compressor or the secondary compressor, so as to open the oil collection pipe in a stopped state of the primary compressor or the secondary compressor.

10. The refrigerating cycle apparatus of claim 8, wherein the valve assembly comprises:

a valve space to which the oil collection pipe is connected in a horizontal direction and which is connected, at one side thereof in a vertical direction, to the discharge side of the primary compressor or the secondary compressor through a gas guide pipe;

a valve slidably inserted in the vertical direction in the valve space and configured to open and close the oil collection pipe; and an elastic member configured to support another side of the valve in the vertical direction thereof.

11. The refrigerating cycle apparatus of claim 6, wherein an oil collection pipe is connected between an inner space of the primary compressor and a suction pipe of the secondary compressor, and wherein a valve assembly to open and close the oil collection pipe is installed at an intermediate portion of the oil collection pipe.

12. The refrigerating cycle apparatus of claim 11, wherein the valve assembly is a solenoid valve.

13. The refrigerating cycle apparatus of claim 6, wherein an oil collection pipe is located between an inner space of the primary compressor and an inner space of the secondary compressor, and wherein a valve assembly to open and close an end portion of the oil collection pipe is installed in the primary compressor and in the second compressor, respectively.

14. The refrigerating cycle apparatus of claim 13, wherein the valve assembly opens and closes the end portion of the oil collection pipe by buoyancy of oil collected in an inner space of the corresponding compressor.

15. The refrigerating cycle apparatus of claim 6, wherein a first oil collection pipe is connected between an inner space of the first compressor and a suction pipe of the secondary compressor, and wherein an oil separator to separate oil from a refrigerant passed through the first oil collection pipe is installed at an intermediate portion of the first coil collection pipe.

16. The refrigerating cycle apparatus of claim 15, wherein the oil separator comprises:

a separation container that communicates with an inlet and an outlet of the first oil collection pipe;

an oil separating member disposed in an inner space of the separation container and configured to separate the oil from the refrigerant;

a second oil collection pipe that communicates with a bottom surface of the separation container and configured to collect the separated oil into the primary compressor; and a valve member installed in the separation container to open and close an inlet of the second oil collection pipe.

17. The refrigerating cycle apparatus of claim 6, wherein an oil collection pipe is connected between an inner space of the primary compressor and a suction pipe of the secondary compressor, and wherein a capillary is installed at an intermediate portion of the oil collection pipe.

18. A method for operating a refrigerating cycle apparatus having a low-stage compressor and a high-stage compressor connected to each other in series, and a refrigerant switching valve connected to a discharge side of the high-stage compressor and having a low-stage side outlet connected to a low-stage side evaporator and a high-stage side outlet connected to a high-stage side evaporator, with the low-stage side evaporator connected to a suction side of the low-stage compressor and the high-stage side evaporator connected to a suction side of the high-stage compressor, the method comprising:

determining that oil balancing is required between the low-stage compressor and the high-stage compressor; and performing an oil balancing operation and transferring oil from one of the low-stage or the high-stage compressor to the other of the low-stage or the high-stage compressor, the one of the low-stage or the high-stage compressor containing more oil than the other of the low-stage or the high-stage compressor, wherein the performing of the oil balancing operation comprises driving at least one of the low-stage compressor or the high-stage compressor for a predetermined period of time, with at least one of the low-stage side outlet of the refrigerant switching valve or the high-stage side outlet of the refrigerant switching valve open or both the low-stage side outlet of the refrigerant switching valve and the high-stage side outlet of the refrigerant switching valve closed, and wherein the performing of the oil balancing operation further comprises driving at least one of the low-stage compressor or the high-stage compressor for a predetermined period of time, with both the low-stage side outlet of the refrigerant switching valve and the high-stage side outlet of the refrigerant switching valve closed.

19. A method for operating a refrigerating cycle apparatus having a low-stage compressor and a high-stage compressor connected to each other in series, and a refrigerant switching valve connected to a discharge side of the high-stage compressor and having a low-stage side outlet connected to a low-stage side evaporator and a high-stage side outlet connected to a high-stage side evaporator, with the low-stage side evaporator connected to a suction side of the low-stage compressor and the high-stage side evaporator connected to a suction side of the high-stage compressor, the method comprising:

determining that oil balancing is required between the low-stage compressor and the high-stage compressor; and performing an oil balancing operation and transferring oil from one of the low-stage or the high-stage compressor to the other of the low-stage or the high-stage compressor, the one of the low-stage or the high-stage compressor containing more oil than the other of the low-stage or the high-stage compressor, wherein the performing of the oil balancing operation comprises driving at least one of the low-stage compressor or the high-stage compressor for a predetermined period of time, with at least one of the low-stage side outlet of the refrigerant switching valve or the high-stage side outlet of the refrigerant switching valve open or both the low-stage side outlet of the refrigerant switching valve and the high-stage side outlet of the refrigerant switching valve closed, and wherein the performing of the oil balancing operation further comprises driving at least one of the low-stage compressor or the high-stage compressor for a predetermined period of time, with both the low-stage side outlet of the refrigerant switching valve and the high-stage side outlet of the refrigerant switching valve open.

20. A method for operating a refrigerating cycle apparatus having a low-stage compressor and a high-stage compressor connected to each other in series, and a refrigerant switching valve connected to a discharge side of the high-stage compressor and having a low-stage side outlet connected to a low-stage side evaporator and a high-stage side outlet connected to a high-stage side evaporator, with the low-stage side evaporator connected to a suction side of the low-stage compressor and the high-stage side evaporator connected to a suction side of the high-stage compressor, the method comprising:

determining that oil balancing is required between the low-stage compressor and the high-stage compressor; and performing an oil balancing operation and transferring oil from one of the low-stage or the high-stage compressor to the other of the low-stage or the high-stage compressor, the one of the low-stage or the high-stage compressor containing more oil than the other of the low-stage or the high-stage compressor, wherein the performing of the oil balancing operation comprises driving at least one of the low-stage compressor or the high-stage compressor for a predetermined period of time, with at least one of the low-stage side outlet of the refrigerant switching valve or the high-stage side outlet of the refrigerant switching valve open or both the low-stage side outlet of the refrigerant switching valve and the high-stage side outlet of the refrigerant switching valve closed, and wherein the performing of the oil balancing operation further comprises driving at least one of the low-stage compressor or the high-stage compressor for a predetermined period of time, with the high-stage side outlet of the refrigerant switching valve open and the low-stage side outlet of the refrigerant switching valve closed.

21. A method for operating a refrigerating cycle apparatus having a low-stage compressor and a high-stage compressor connected to each other in series, and a refrigerant switching valve connected to a discharge side of the high-stage compressor and having a low-stage side outlet connected to a low-stage side evaporator and a high-stage side outlet connected to a high-stage side evaporator, with the low-stage side evaporator connected to a suction side of the low-stage compressor and the high-stage side evaporator connected to a suction side of the high-stage compressor, the method comprising:

determining that oil balancing is required between the low-stage compressor and the high-stage compressor; and performing an oil balancing operation and transferring oil from one of the low-stage or the high-stage compressor to the other of the low-stage or the high-stage compressor; the one of the low-stage or the high-stage compressor containing more oil than the other of the low-stage or the high-stage compressor, wherein the performing of the oil balancing operation comprises driving at least one of the low-stage compressor or the high-stage compressor for a predetermined period of time, with at least one of the low-stage side outlet of the refrigerant switching valve or the high-stage side outlet of the refrigerant switching valve open or both the low-stage side outlet of the refrigerant switching valve and the high-stage side outlet of the refrigerant switching valve closed, and wherein the performing of the oil balancing operation further comprises driving at least one of the low-stage compressor or the high-stage compressor for a predetermined period of time, with the high-stage side outlet of the refrigerant switching valve closed and the low-stage side outlet of the refrigerant switching valve open.

* * * * *